US008126360B2

(12) United States Patent
Kawasaki et al.

(10) Patent No.: US 8,126,360 B2
(45) Date of Patent: Feb. 28, 2012

(54) TEMPERATURE CONTROL UNIT FOR ELECTROPHOTOGRAPHIC PHOTOCONDUCTOR SUBSTRATE

(75) Inventors: Yoshiaki Kawasaki, Shizuoka (JP); Akihiro Sugino, Shizuoka (JP); Mitsuaki Hirose, Shizuoka (JP); Susumu Muramatsu, Shizuoka (JP); Katsuo Kuribayashi, Shizuoka (JP); Shoichi Wakabayashi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 69 days.

(21) Appl. No.: 12/746,417

(22) PCT Filed: Dec. 4, 2008

(86) PCT No.: PCT/JP2008/072466

§ 371 (c)(1), (2), (4) Date: Jun. 4, 2010

(87) PCT Pub. No.: WO2009/072667

PCT Pub. Date: Jun. 11, 2009

(65) Prior Publication Data

US 2010/0260513 A1 Oct. 14, 2010

(30) Foreign Application Priority Data

Dec. 6, 2007 (JP) ..... 2007-315465

(51) Int. Cl.
*G03G 15/02* (2006.01)

(52) U.S. Cl. ..... 399/116; 399/159; 430/127

(58) Field of Classification Search ..... 399/91, 399/94, 96, 107, 116, 159; 430/127, 130–136; 427/553, 557, 558; 118/641; 492/4
See application file for complete search history.

(56) References Cited

U.S. PATENT DOCUMENTS

| | | | | |
|---|---|---|---|---|
| 5,722,016 | A * | 2/1998 | Godlove et al. | 399/159 |
| 6,212,342 | B1 * | 4/2001 | Fritz | 399/91 |
| 6,777,150 | B2 | 8/2004 | Suzuki et al. | |
| 6,816,691 | B2 | 11/2004 | Kabata et al. | |
| 7,005,006 | B2 | 2/2006 | Suzuki et al. | |
| 7,010,247 | B2 | 3/2006 | Suzuki et al. | |
| 7,027,759 | B2 | 4/2006 | Kabata et al. | |
| 7,267,916 | B2 | 9/2007 | Sugino et al. | |
| 7,314,693 | B2 | 1/2008 | Ikegami et al. | |
| 7,354,686 | B2 | 4/2008 | Toda et al. | |
| 7,416,823 | B2 | 8/2008 | Yanagawa et al. | |

(Continued)

FOREIGN PATENT DOCUMENTS

| | | |
|---|---|---|
| JP | 56-048637 | 5/1981 |

(Continued)

*Primary Examiner* — David Porta
*Assistant Examiner* — Benjamin Schmitt
(74) *Attorney, Agent, or Firm* — Cooper & Dunham LLP

(57) ABSTRACT

There is provided a temperature control unit for an electrophotographic photoconductor substrate, containing a stretchable membrane member which is detachably disposed in a hollow space of the cylindrical substrate, wherein the membrane member is configured to sequentially stretch until reaching the deepest part of the hollow space of the cylindrical substrate as a result of an introduction of a refrigerant therein to closely contact with an entire inner wall of the cylindrical substrate, and to sequentially shrink to the original shape thereof as a result of a release of the refrigerant therefrom, so that the membrane member is detachably disposed in the hollow space, and wherein the membrane member is configured to make a heat transfer between a surface of the cylindrical substrate and the refrigerant via the membrane member closely contacted with the inner surface of the cylindrical substrate, to control a surface temperature of the cylindrical substrate.

15 Claims, 15 Drawing Sheets

U.S. PATENT DOCUMENTS

| | | | |
|---|---|---|---|
| 7,473,504 | B2 | 1/2009 | Yanagawa et al. |
| 2005/0287452 | A1 | 12/2005 | Tamura et al. |
| 2006/0141378 | A1 | 6/2006 | Takada et al. |
| 2008/0138728 | A1 | 6/2008 | Sugino et al. |

FOREIGN PATENT DOCUMENTS

| | | |
|---|---|---|
| JP | 63-077061 | 4/1988 |
| JP | 7-013346 | 1/1995 |
| JP | 7-010912 | 2/1995 |
| JP | 3154263 | 2/2001 |
| JP | 2001-125297 | 5/2001 |
| JP | 3194392 | 6/2001 |
| JP | 3286707 | 3/2002 |
| JP | 3286711 | 3/2002 |
| JP | 2004-302451 | 10/2004 |
| JP | 2004-302452 | 10/2004 |
| JP | 2005-258019 | 9/2005 |
| JP | 2006-011001 | 1/2006 |
| JP | 2006-255679 | 9/2006 |
| JP | 2007-264625 | 10/2007 |
| JP | 4145820 | 6/2008 |

* cited by examiner

FIG. 14A
FIG. 14B
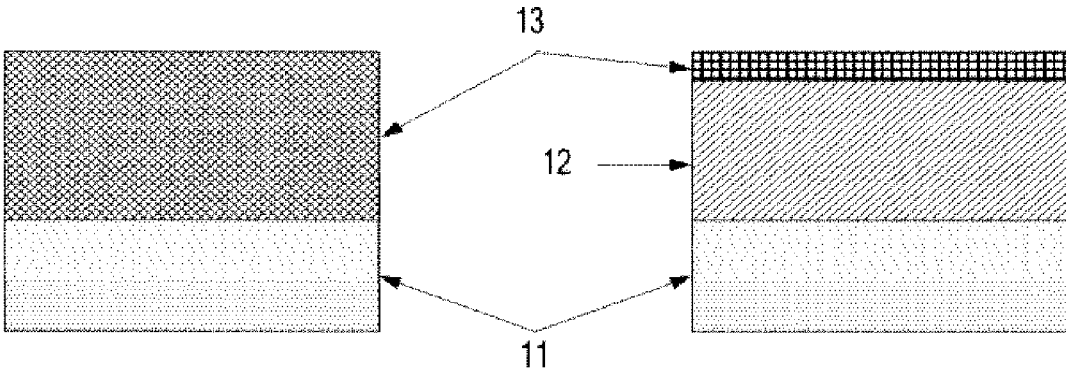
FIG. 15A
FIG. 15B
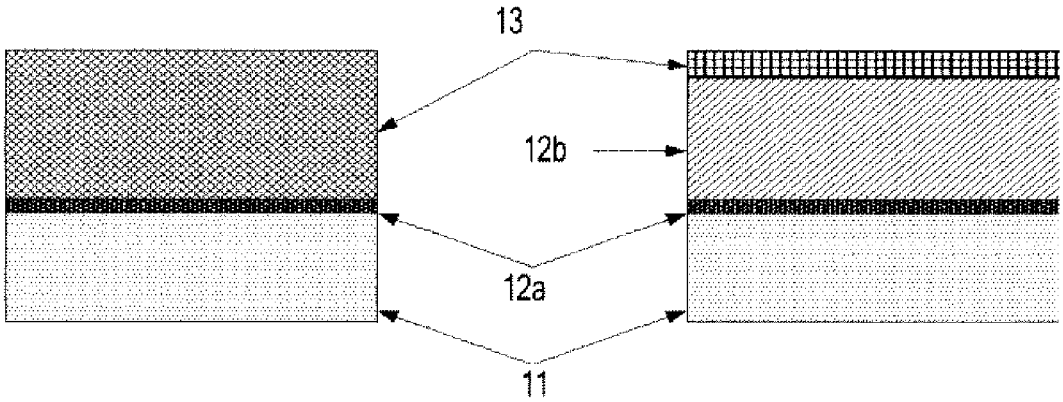

TEMPERATURE CONTROL UNIT FOR ELECTROPHOTOGRAPHIC PHOTOCONDUCTOR SUBSTRATE

TECHNICAL FIELD

The present invention relates to a temperature control unit for a substrate of an electrophotographic photoconductor.

BACKGROUND ART

In recent years, an organic photoconductor (OPC) has replaced an inorganic photoconductor, and has been commonly used for a copying machine, a facsimile, a laser printer, or a complex machine combining thereof in view of its excellent performances and various advantages. The main reasons therefore are, for example, (a) optical characteristics thereof such as a wide wavelength region and large quantity of light absorption, (b) electrical characteristics thereof such as high sensitivity and stable charging ability, (c) a wide range of selections for a material to be used, (d) easy production, (e) low cost, (f) no hazards, and the like.

In addition to the above, the diameter of the photoconductor has been more and more downsized along with the downsizing of the image forming devices, and highly resistant photoconductor has been strongly desired in view of high-speeded operation and maintenance-free for the device. From this point of view, the organic photoconductor has disadvantages such that it is generally soft as the main components of the surface layer thereof are a low molecular charge transport material and an inactive polymer, the abrasions are prone to occur due to the physical loads from the developing system or cleaning system at the time of repeated use in the process of the electrophotography. In addition, the increase in the hardness of the rubber of the cleaning blade and the increased contact pressure are necessary as the diameters of the toner particles are more and more downsized for the purpose of achieving the high image quality. These are other factors to accelerate the wearing of the photoconductor. Such the wearing of the photoconductor leads the deterioration of the sensitivity, deterioration of the electric characteristics such as lowing of the chargability, lowing of the image density, and the generation of defective images such as background depositions. Moreover, the scratches from the partially caused wearing lead images of lined depositions due to the cleaning failure. Under the current circumstances, the life-long of the photoconductor is limited as a result of this wearing or scratches, and the replacement thereof becomes necessary.

Accordingly, it is necessary to reduce the amount of the aforementioned wearing in view of the achievement of the highly durable organic photoconductor, and this is an urgent problem to be solved in this field.

As the technique which improves the abrasion resistance of the photoconductive layer, (1) the technique which uses a curable binder resin in the surface layer (for example, refer to Patent Literature 1), (2) the technique which uses a macromolecular charge transporting material (for example, refer to Patent Literature 2), and (3) the technique in which inorganic fillers are dispersed in the surface layer (for example, refer to Patent Literature 3) are proposed. Among these techniques, the technique (1) using the curable binder resin tends to increase the residual potential and thus lowers the image density due to the impurities such as unreacted residual groups, as the compatibility of the charge transporting material and the polymerization initiator is poor. Moreover, the technique (2) using the macromolecular charge transporting material and the technique (3) dispersing the inorganic fillers are capable of improving the abrasion resistance at a certain degree, but such abrasion resistance is not sufficient enough to achieve the degree required for the organic photoconductor. Furthermore, the technique (3) dispersing the inorganic fillers increases the residual potential due to the trap present on the surfaces of the inorganic fillers, and thus the image density is prone to be lowered. The techniques (1), (2) and (3) have not sufficiently achieved the total resistance including the electrical resistance and physical resistance required for the organic photoconductor.

As an alternative technique for improving the abrasion resistance of the photoconductor to the above, it has been known the technique such that a charge transporting layer is formed by using a coating liquid containing a monomer having a C—C double bond, a charge transporting material having a C—C double bond, and a binder resin (for example, refer to Patent Literature 4). The abrasion resistance and the electric characteristics are significantly improved especially by disposing, as a surface layer, a crosslinked resin layer which is formed by curing at least a tri- or more functional radical polymerizable monomer having no charge transporting structure and a radical polymerizable compound having a charge transporting structure by UV radiation (for example, refer to Patent Literatures 5, 6, and 7). In the crosslinked resin layer, three-dimensional crosslinkages are formed as a result that the coated layer of the tri- or more functional radical polymerizable monomer having no charge transporting structure and the radical polymerizable compound are irradiated with a UV light. However, if a cylindrical substrate is exposed with the UV light, the cylindrical substrate will have an extremely high temperature due to such the light energy and heat of the reaction at the time of crosslinking. Although the appropriate increase of the temperature smoothly proceed with the crosslinking reaction, the extreme increase of the temperature may lead the deterioration of the electric characteristics, and thus the temperature of the cylindrical substrate needs to be controlled.

It has been known the technical concept of the broad sense, such that a substrate for a photoconductor is cooled at the time of producing an electrophotographic photoconductor by coating various coating liquids, drying the coated films, and then curing the films. For example, Patent Literature 8 discloses that the substrate of hollow tube is cooled by externally blowing a cooled air at the time of dip-coating and drying the substrate of the photoconductor in the manufacturing process of the electrophotographic photoconductor. Patent Literature 9 discloses that the substrate drum is cooled by introducing a gas or liquid for cooling into the chuck which fix, support and moves the substrate drum while griping. Patent Literature 10 discloses that the cylindrical substrate is cooled by inserting the small cylindrical tube having the cooling water supplying tube and the cooling water releasing tube into the hollow space of the cylindrical substrate. In these conventional techniques, the problems such as the depositions from the ultra fine suspended substances generated in a cooling medium as a result of the direct contact of the cooling medium with the surface of the substrate material, time-loss caused by blast drying the wet cooling medium, the stains on the inner wall of the cylindrical tube as the marks of fine droplets, depositions of the dirt contained in the blast, and the like are not taken into consideration. Although it is presumed to achieve the good heat transfer efficiency as a result of the direct contact and the uniform cooling, however, those techniques still remains the aforementioned problems to be solved. Therefore, it has been desired to solve various problems due to the direct contact of the cooling medium, as well as achieving the uniform cooling and high efficiency of the cooling. For example, if the substrate is placed in the resting state, it may not cause an extreme defect such as a drip of the liquid, but uneven drying or curing of the coated film, or partially uneven cooling may be occur.

Patent Literature 11 discloses that the cooling device is formed from an elastic material such as a rubber, whose shape is enlarged and expanded once it is inserted inside a cylindrical substrate, and the cooling device is inserted in the cylindrical substrate, and the liquid is poured into the cooling device to thereby cool the cylindrical substrate. However, the cylindrical substrate cannot be cooled while being rotated in accordance with this method. Moreover, the elastic body is not used simply to introduce a refrigerant, but to press using a pressure control valve. The chucking part thereof is not connected with the elastic body, the temperature thereof cannot be controlled if the UV light is irradiated thereto, and the temperature of the chucking part becomes high. Moreover, Patent Literature 10 does not disclose any special consideration for the even cooling and the improvement of the cooling efficiency by uniformly contacting the elastic material to the inner wall of the cylindrical substrate in accordance with a simple method.

[Patent Literature 1] Japanese Patent Application Laid-Open (JP-A) No. 56-48637

[Patent Literature 2] Japanese Patent Application Laid-Open (JP-A) No. 64-1728

[Patent Literature 3] Japanese Patent Application Laid-Open (JP-A) No. 04-281461

[Patent Literature 4] Japanese Patent (JP-B) No. 3194392

[Patent Literature 5] Japanese Patent Application Laid-Open (JP-A) No. 2004-302450

[Patent Literature 6] Japanese Patent Application Laid-Open (JP-A) No. 2004-302451

[Patent Literature 7] Japanese Patent Application Laid-Open (JP-A) No. 2004-302452

[Patent Literature 8] Japanese Patent Application Laid-Open (JP-A) No. 2006-255679

[Patent Literature 9] Japanese Patent Application Laid-Open (JP-A) No. 63-77061

[Patent Literature 10] Japanese Patent Application Laid-Open (JP-A) No. 08-15876

[Patent Literature 11] Japanese Patent (JP-B) No. 3154263

DISCLOSURE OF INVENTION

An object of the present invention is to provide a temperature control unit for a cylindrical substrate, which is configured to easily and uniformly control and suppress an increase in a temperature of the cylindrical substrate as a whole at the time of ultraviolet radiation.

As a result of the intensive studies and researches conducted by the present inventors, it was found that the aforementioned problems could be solved by the following temperature control unit, and this led the present invention.

The means for solving the aforementioned problems are as follows:

<1> A temperature control unit for an electrophotographic photoconductor substrate, in which the electrophotographic photoconductor substrate contains a coated layer, and an entire face of the electrophotographic photoconductor substrate is exposed to energy externally applied from a heating element while being rotated by a rotation system, characterized in that:

the temperature control unit containing a stretchable membrane member, said membrane member detachably disposed in a hollow space of the cylindrical substrate.

wherein the membrane member is configured to sequentially stretch until reaching the deepest part of the hollow space of the cylindrical substrate as a result of an introduction of a refrigerant therein so as to closely contact with an entire inner wall of the cylindrical substrate, and to sequentially shrink to the original shape thereof as a result of a release of the refrigerant therefrom, so that the membrane member is detachably disposed in the hollow space of the cylindrical substrate, and wherein the membrane member is configured to make a heat transfer between a surface of the cylindrical substrate and the refrigerant introduced in the hollow space of the cylindrical substrate via the membrane member closely contacted with the inner surface of the cylindrical substrate, so as to control a surface temperature of the cylindrical substrate.

<2> The temperature control unit of according to <1>, further containing a membrane member assisting system for a close contact configured to assist the membrane member to closely contact with the entire inner wall of the cylindrical substrate at the time when the refrigerant is introduced.

<3> The temperature control unit according to any one of <1> or <2>, further containing:

a refrigerant introducing part, from which the pressurized refrigerant is introduced into the hollow space of the cylindrical substrate; and a refrigerant releasing part, to which the refrigerant introduced in the inside of the hollow part of the cylindrical substrate is spontaneously released.

<4> The temperature control unit according to <3>, wherein the refrigerant introducing part and the refrigerant releasing part are a double pipe comprising an inner pipe and an outer pipe, wherein the double pipe is disposed so as to be on the same axis to a rotation axis of the cylindrical substrate, and is configured to introduce and release the refrigerant in and from the hollow space of the cylindrical substrate, wherein the outer pipe is connected to an entrance part of the hollow space of the cylindrical substrate, and the inner pipe is inserted into the hollow space of the cylindrical space in a manner such that an opening thereof is located at the deepest part of the hollow space of the cylindrical substrate, so that the refrigerant flown out from the entrance part or the deepest part pushes and presses the membrane member towards the inner wall of the cylindrical substrate to make the membrane member contact with the inner wall of the cylindrical substrate.

<5> The temperature control unit according to <4>, wherein the double pipe has a width of an annular channel of 2 mm or more, where the annular channel is a space between an outer face of the inner pipe and an inner face of the outer pipe.

<6> The temperature control unit according to any one of <1> to <4>, wherein the membrane member is at least one side of a bag structure, wherein said side has an elasticity, and functions as a chuck in a manner such that said side stretches as the refrigerant is introduced into the bag structure, and contacts with the inner wall of the cylindrical substrate so as to hold the cylindrical substrate.

<7> The temperature control unit according to <6>, wherein the bag structure is configured to release the refrigerant and shrink back to the original shape, once the introduction of the refrigerant is terminated.

<8> The temperature control unit according to any one of <6> or <7>, wherein the temperature control unit further contains a rigid tube disposed in the hollow space of the cylindrical substrate so as to be on the same axis to a rotation axis of the cylindrical substrate, and the bag structure is a cylindrical bag structure comprising a circular through-hole in a center thereof, wherein the cylindrical bag structure is disposed on the rigid tube so that an inner circumference of an inner surface of the membrane member contacts with an outer circumference of a surface of the rigid tube, and the refrigerant is introduced in between the outer circumference of the surface of the rigid tube and the inner circumference of the inner surface of the membrane member.

<9> The temperature control unit according to any one of <6> to <8>, wherein the hag structure is a cylindrical elastic body which is detachably disposed in the hollow space of the cylindrical substrate.

<10> The temperature control unit according to any one of <6> to <9>, wherein the bag structure is a chuck configured to hold the cylindrical substrate from the hollow space of the cylindrical substrate, and to rotate thereof so as to rotate the cylindrical substrate while holding thereof.

<11> The temperature control unit according to any one of <3> to <10>, further containing a refrigerant circulation system configured to reintroduce the spontaneously released refrigerant into the refrigerant introducing part via a temperature-constant bath.

<12> The temperature control unit according to any one of <8> to <11>, further comprising a pipe for the refrigerant, which is inserted into the circular through-hole of the cylindrical bag structure, and is configured to introduce and release the refrigerant.

<13> The temperature control unit according to any one of <9> to <12>, wherein a thickness of the cylindrical elastic body at where closely contacting with the entire inner wall of the cylindrical substrate is 1.0 time to 2.0 times of a thickness of the top and bottom ends of the cylindrical elastic body at where contacting with the inner wall of the cylindrical substrate, and wherein a part of the cylindrical elastic body where the thickness thereof changes is shaped in a taper or a curve.

<14> The temperature control unit according to any one of <8> to <13 further comprising a couple of metal or resin disk pressing tools respectively disposed at the top and bottom of the cylindrical substrate, wherein the couple of metal or resin disk pressing tools are configured to perform a positioning of a location where the cylindrical substrate is held with the cylindrical elastic body.

<15> The temperature control unit according to any one of <11> to <14>, further containing:

a refrigerant storage tank as the constant-temperature tank;

a refrigerant supplying pipe connecting between the refrigerant storage tank and the cylindrical elastic body;

a pump equipped with the refrigerant supplying pipe, and configured to send the refrigerant from the refrigerant storage tank into the cylindrical elastic body;

a refrigerant releasing pipe connecting between the cylindrical elastic body and the refrigerant storage tank, and configured to release the circulated the refrigerant in the cylindrical elastic body to the refrigerant storage tank;

a pressure detector configured to monitor a pressure of the and a flow rate control system configured to control the flow rate of the refrigerant.

In accordance with the temperature control unit for an electrophotographic photoconductor substrate of the present invention, the increase in the temperature of the cylindrical substrate caused, for example, by the heat from the UV lamp is easily and uniformly suppressed by controlling the temperature of the cylindrical substrate, and as a result, the high abrasion resistance and scratch resistance, and stable static characteristics of the electrophotographic photoconductor can be maintained.

BRIEF DESCRIPTION OF DRAWINGS

FIG. 14A and FIG. 14B are cross-sectional views of examples of an electrophotographic photoconductor for use in the present invention.

FIG. 15A and FIG. 15B are cross-sectional views of examples of an electrophotographic photoconductor for use in the present invention.

BEST MODE FOR CARRYING OUT THE INVENTION

Hereinafter, the present invention will be precisely described with reference to the drawings.

The temperature control unit of the present invention contains a membrane member which is fixed on, or detachably attached to an entire inner wall of a cylindrical substrate that has a coated layer and is exposed to energy externally applied from a heating element, wherein a refrigerant is introduced into a inner part of the membrane member and is configured to control a surface temperature of the cylindrical substrate via the membrane member, while self-rotating the cylindrical substrate.

In accordance with the present invention, the surface temperature of the cylindrical photoconductive substrate is controlled and maintained at 150° C. or lower, preferably 130° C. or lower. The surface temperature of the substrate can be easily determined, for example, by measuring the surface temperature at the opposite position to the irradiating position of the heating element (e.g. an irradiation lamp) (a position where is 180 degrees apart from the irradiated position on the cylinder which is rotated at the rotation frequency of 25 rpm).

The membrane member is easily inserted into a hollow space of the cylindrical substrate, is elongation-expandable at a pressure of 500 hPa/cm2 to 10,000 hPa/cm2 or by the weight of the liquid refrigerant, e.g. water, to be introduced therein, and is highly stretchable so as to closely contact with the inner wall of the cylindrical substrate. The membrane member is preferably elongated in two axial directions, and stretches till reaching the deepest part of the cylindrical substrate in the longer direction thereof. The aforementioned degree of the pressure is sufficiently attained by water pressure of an urban water supply system. Moreover, the membrane member has enough thermal conductivity to cool the cylindrical substrate promptly.

The material for the membrane member is preferably the one having a high stretchability, such as natural rubber, synthetic rubber, or the like. In addition, other rubber materials, which excel in water resistance, abrasion resistance, light fastness, heat resistance, and the like, may be formulated in the aforementioned material. The forming method of the membrane member is selected from the conventional forming methods known in the art. Specific examples thereof include a sheet forming method, extrusion molding method, and the like.

Figure 1:
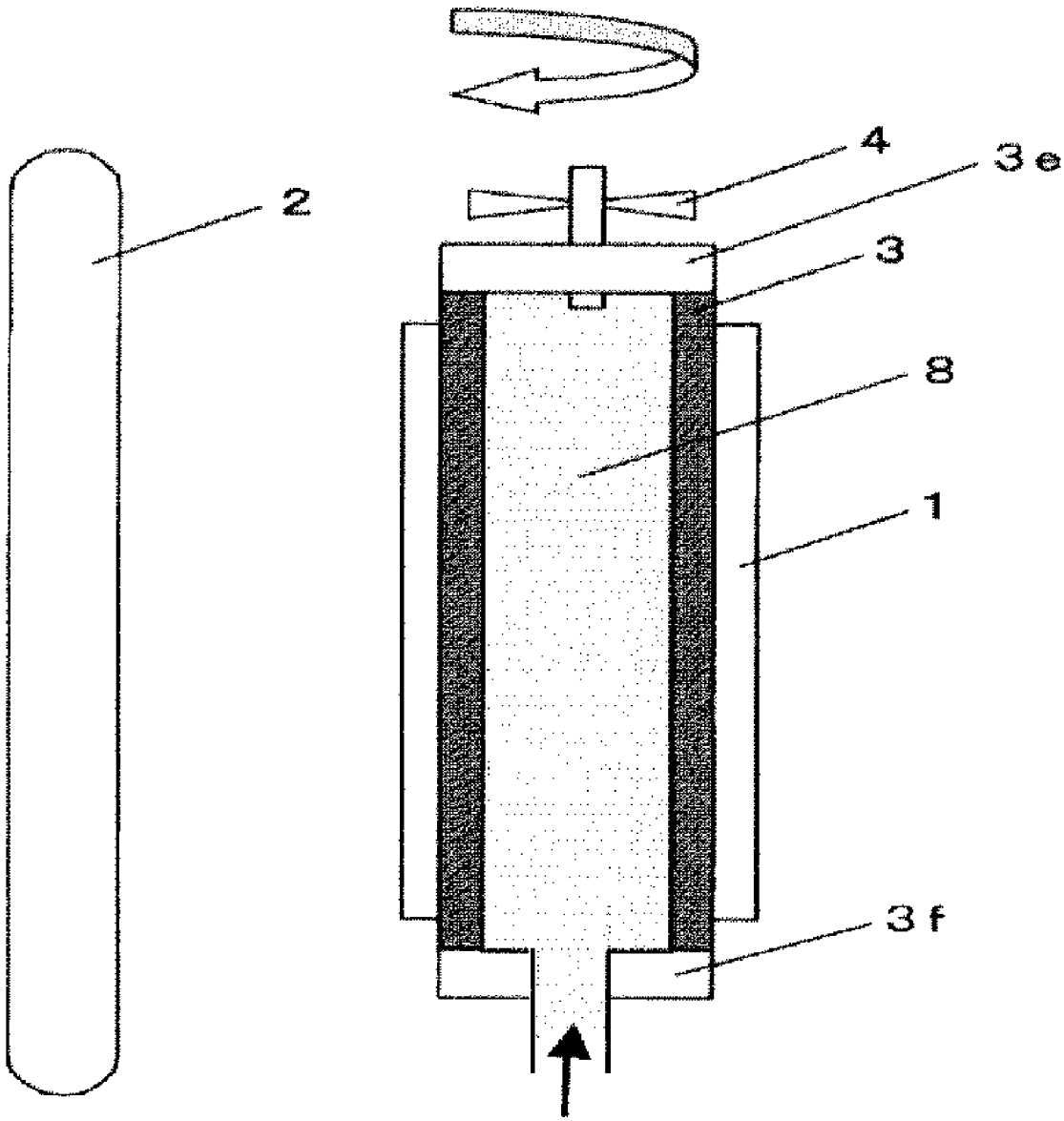
FIG. 1 is a schematic diagram showing a structural example of the temperature control unit which is suitable for carrying out the present invention.

As shown in FIG. 1, in the case where the heating element 2 such as a UV lamp or the like is disposed nearby the cylindrical substrate 1 which is rotated by means of a rotation system (which is not illustrated), the heat generated on the cylindrical substrate 1 by the heating element 2 is removed by introducing the refrigerant 8 into the inner part of the membrane member 3 which is closely contacted with the inner part of the cylindrical substrate 1, and the temperature of the cylindrical substrate 1 is controlled via the membrane member 3 in this manner. The membrane member 3 is sequentially expanded and elongated as the refrigerant 8 is introduced therein, and sequentially closely contacts with the entire inner wall of the cylindrical substrate 1. In the embodiment shown in FIG. 1, the air in the hollow space of the cylindrical substrate 1 is removed by means of an air release valve 9 which is one example of the assisting means for the close contact of the membrane member 3 so as to assist the membrane member to sufficiently closely contact with the cylindrical substrate 1 at the time when the refrigerant 8 is introduced. In this manner, any insufficient contacts are completely removed. As has mentioned above, it can be understood from the aforementioned example of the vacuumed contact that the membrane member 3 is elongated-expandable at the pressure of 500 hPa/cm$^2$ to 10,000 hPa/cm$^2$, and is highly stretchable so as to closely contact with the inner wall of the cylindrical substrate 1. In FIG. 1, the references 3*e* and 3*f* respectively denote top and bottom pressing tools (lid members).

Since the liquid used as the refrigerant and the cylindrical substrate do not have any contact to each other, the liquid will not be scattered on a photoconductive layer even in the case where the photoconductive layer is disposed on the surface of the cylindrical substrate, and thus any defects on the coated layer due to the deposition of the liquid can be prevented, and thus uniform cooling can be easily and accurately achieved.

Figure 2:
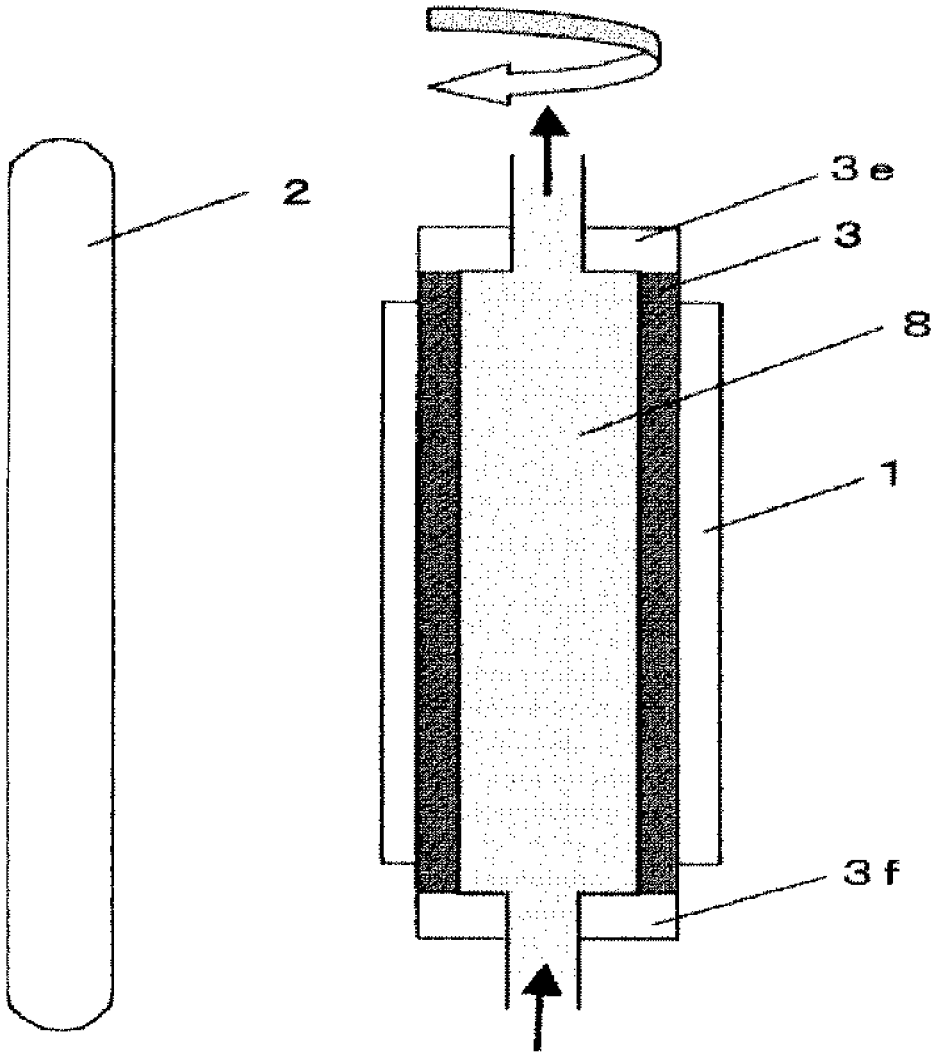
FIG. 2 is a schematic diagram showing a structural example of the temperature control unit which is suitable for carrying out the present invention.

FIG. 2 shows another embodiment of the temperature control unit of the present invention. As shown in FIG. 2, in the present invention, the membrane member 3 is closely contacted with the inner wall of the cylindrical substrate 1 which is rotated while receiving thermal energy from the heating element 2, and the refrigerant 8 is introduced into the membrane member 3 from one direction (shown with the arrow directing the down side in FIG. 2) and is released to another direction (shown with the arrow directing the up side in FIG. 2). In this manner, the interchange of heat is efficiently performed. In this embodiment, the membrane member 3 is an elastic body in the shape of the cylinder (referred as a cylindrical elastic body, hereinafter) which contacts with the entire inner wall of the cylindrical substrate 1. Moreover, the air release valve as the assisting means for the close contact of the membrane member is not used in the unit of this embodiment. The flows occurred by the introduction-release of the refrigerant support the close contact of the membrane member 3. In addition, the flow direction of the refrigerant can be reversely changed.

Figure 3:
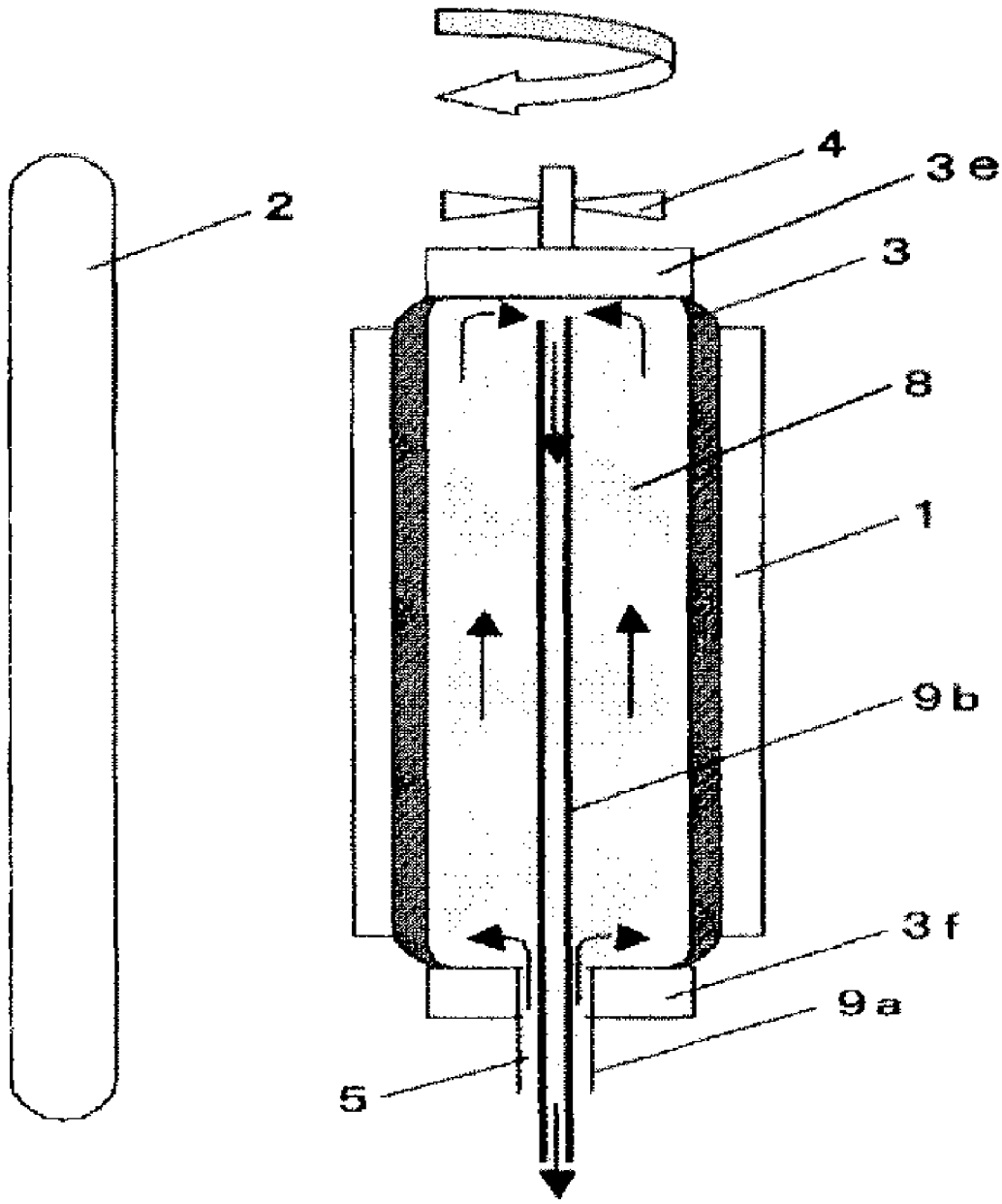
FIG. 3 is a schematic diagram showing a structural example of the temperature control unit which is suitable for carrying out the present invention.
Figure 4:
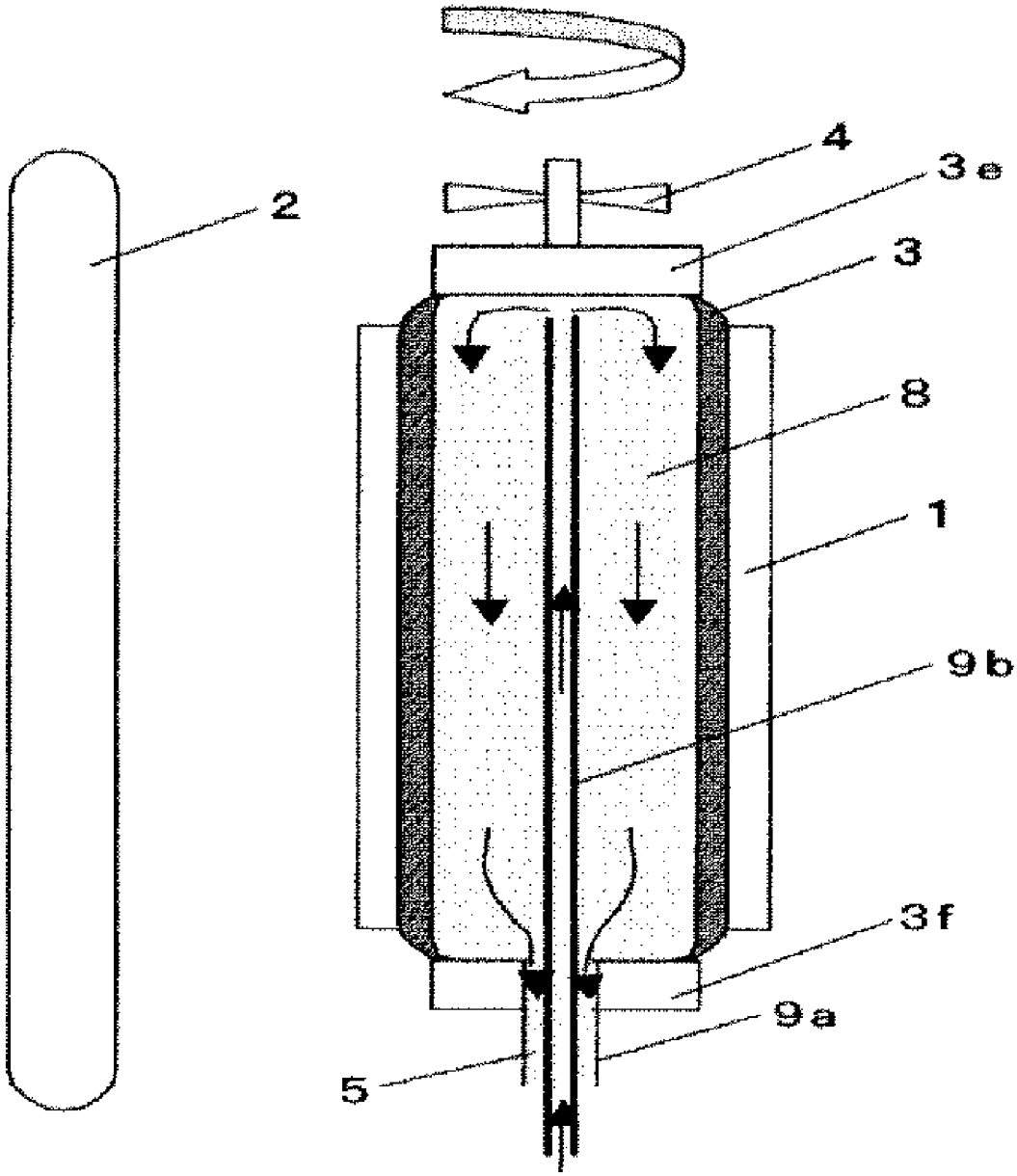
FIG. 4 is a schematic diagram showing a structural example of the temperature control unit which is suitable for carrying out the present invention.

Other embodiments of the heat control unit of the present invention are shown in FIGS. 3 and 4. In these embodiments, the refrigerant 8 is introduced into the hollow part through a double pipe comprised of an outer pipe 9*a* having a relatively large diameter and inner pipe 9*b* having a relatively small diameter and inserted from one end (the bottom end in the drawings) of the rotated cylindrical elastic body comprised of the membrane member 3 into the inner part. The refrigerant 8 is then released from the hollow part, while transferring the heat via the cylindrical elastic body of the membrane member 3 which contacts with the entire inner wall of the cylindrical substrate 1. The double pipe is disposed on the same axis to the rotation axis of the rotated cylindrical substrate 1. The outer pipe 9*a* of the double pipe is connected in a manner such that an opening thereof becomes an entrance part (the bottom part in the drawings) of the hollow part of the cylindrical substrate 1, and the inner pipe 9*b* of the double pipe is disposed in a manner such that an opening thereof is positioned at the deepest part of the hollow space of the cylindrical substrate 1. The refrigerant 8 is introduced in an annular channel 5 which is a space made between the outer pipe 9*a* and the inner pipe 9*b*. After entering into the annular channel 5, the refrigerant 8 moves forward until it reaches the deepest part, while sequentially pressing the membrane member 3 of the cylindrical elastic body functioned as the outer pipe 9*a* towards the inner wall of the substrate 1 so as to make the membrane member 3 closely contact with the inner wall of the substrate 1. Thereafter, the refrigerant 8 is flown into the inner pipe 9*b*, and then released therefrom (FIG. 3). In the case where the refrigerant 8 is introduced from the inner pipe 9*b* as shown in FIG. 4, the refrigerant 8 is flown into the outer pipe 9*a* after reaching the deepest end of the inner pipe 9*b*, and is then released from the terminal part (the bottom part in FIG. 4) of the annular channel 5. Note that, the annular channel 5 defines a space in between the outer surface of the inner pipe 9*b* and the inner surface of the outer pipe 9*a*.

Figure 5:
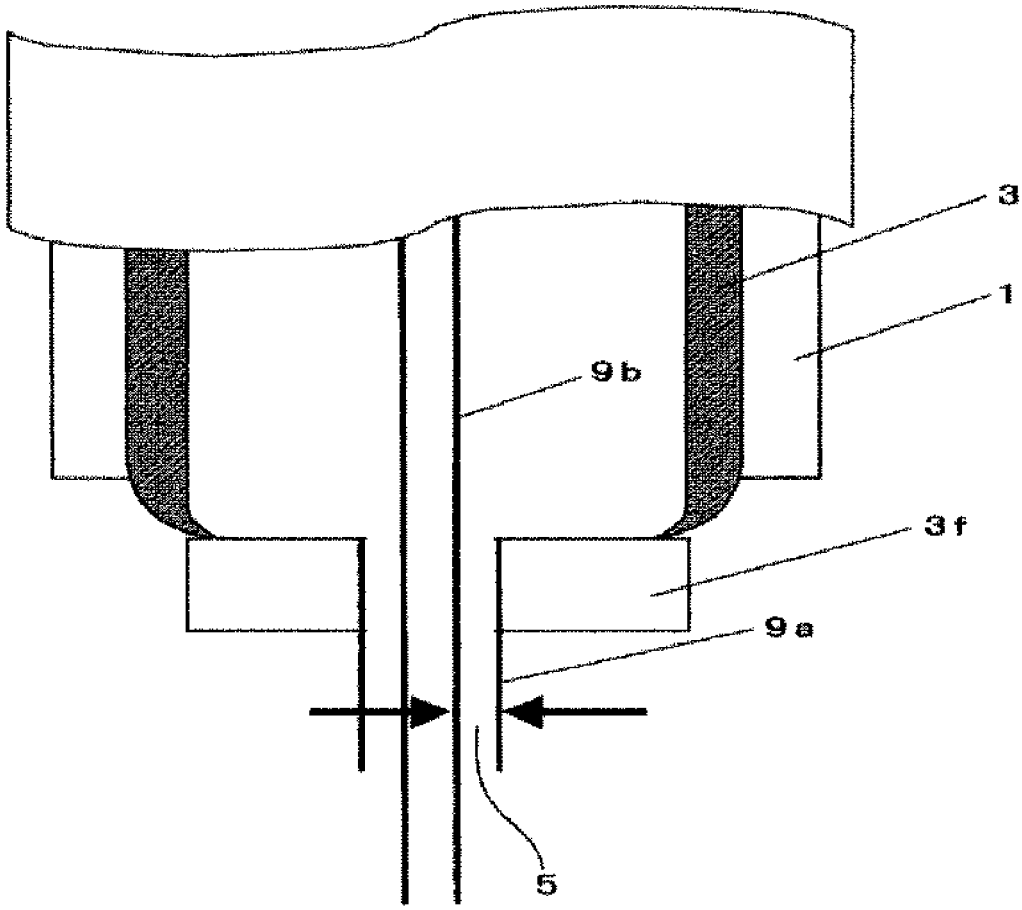
FIG. 5 is a schematic diagram showing a structural example of the temperature control unit which is suitable for carrying out the present invention.

The width of the annular channel 5 is preferably 2 mm or more as shown in FIG. 5. Specifically, the annular channel 5 is a space in between the outer surface of the inner pipe 9*b* and the inner surface of the outer pipe 9*a* within the double pipe, the double pipe is disposed inside the membrane member 3 of the cylindrical elastic body so as to be parallel to the rotation axis direction of the cylindrical substrate 1 and to have the same axis as the centric axis of the cylindrical substrate, and the membrane member 3 of the cylindrical elastic body is disposed so as to contact with the entire inner surface of the cylindrical substrate 1 of the heat control unit.

By adjusting the width (space) of the annular channel 5 between the outer surface of the inner pipe 9*b* and the inner surface of the outer pipe 9*a*, any loss of the pressure is reduced and the appropriate circulated flow rate of the refrigerant is maintained. In the case where the space (5) is smaller than 2 mm, the loss of the pressure is increased, the circulated flow rate of the refrigerant is reduced, and thus the variations in the temperature of the cylindrical substrate 1 become significant.

In the temperature control unit of the present invention, the membrane member is at least an outer face of a bag structure 3*a*, the outer face of the bag structure 3*a* is elastic and stretched as the refrigerant is introduced inside the bag structure 3*a*, and the elastic outer face of the bag structure 3*a* enables to be held from the inner surface of the cylindrical substrate 1. Moreover, the bag structure is shrunk to the original shape once the introduction of the refrigerant is terminated and the refrigerant is released therefrom.

Figure 6:
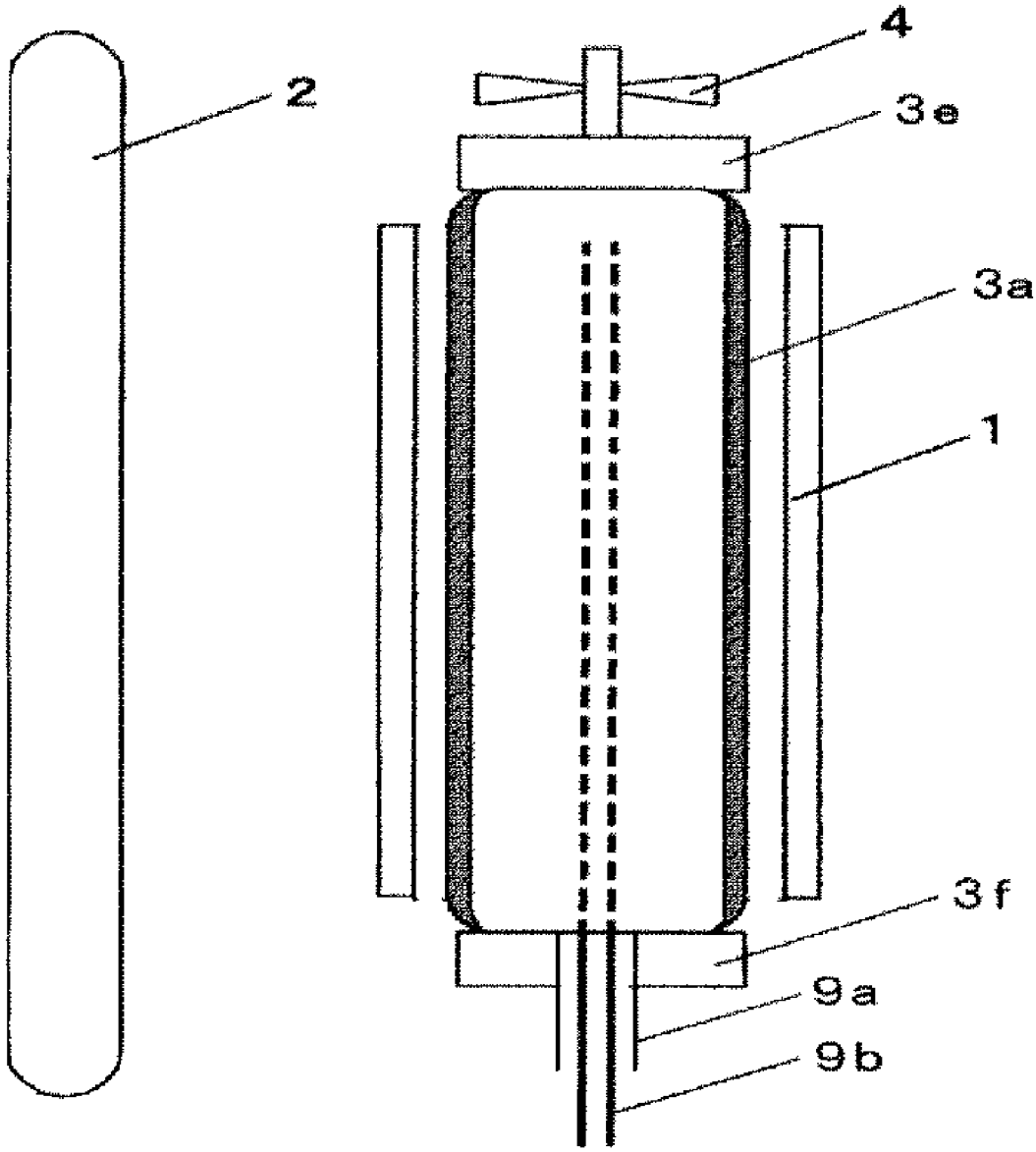
FIG. 6 is a schematic diagram showing a structural example of the temperature control unit which is suitable for carrying out the present invention.

Namely, the elastic bag structure 3*a* does not contact with the cylindrical substrate 1, when no refrigerant is introduced, as shown in FIG. 6. In this state, the cylindrical substrate 1 is detachable from the heat control unit.

Figure 7:
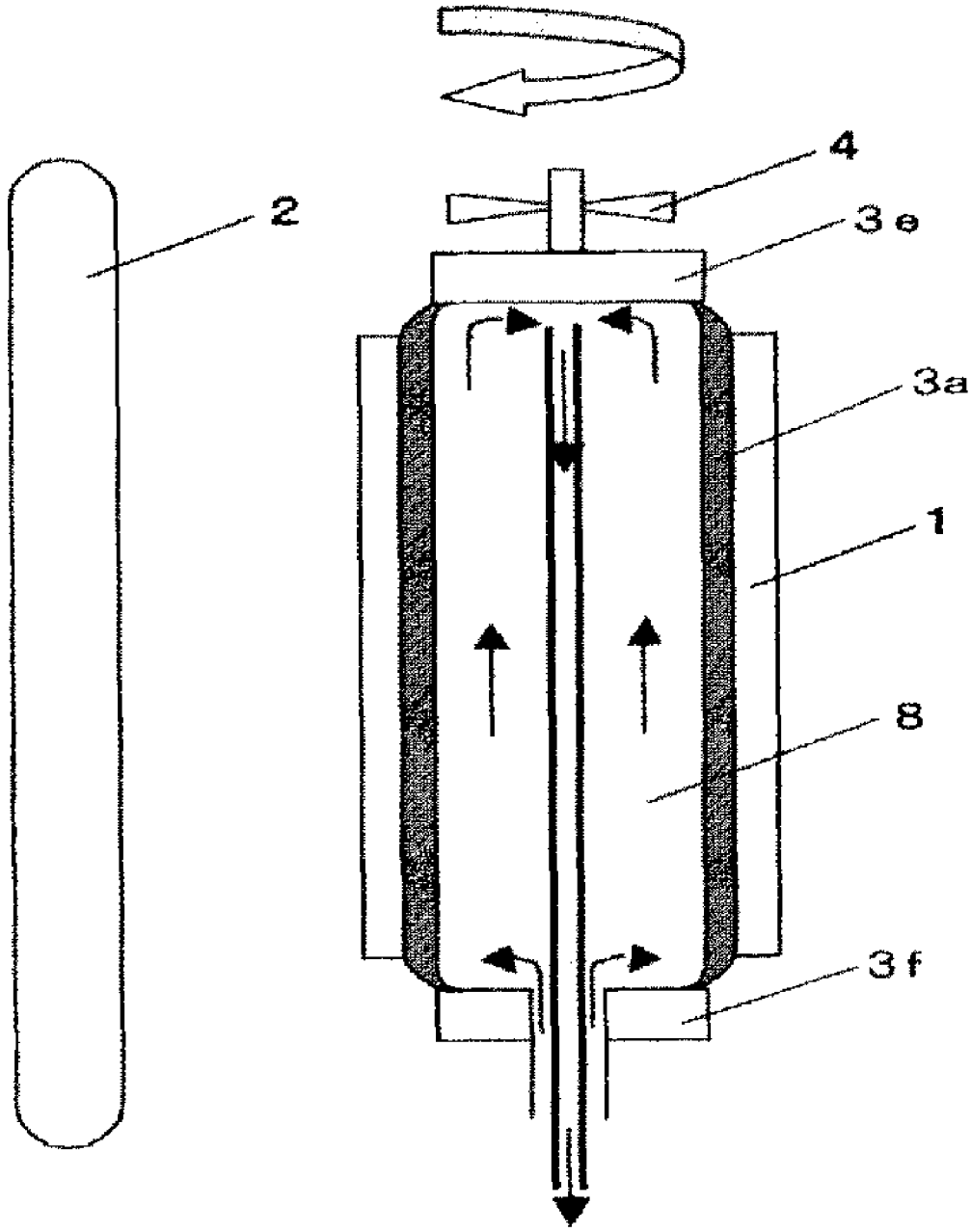
FIG. 7 is a schematic diagram showing a structural example of the temperature control unit which is suitable for carrying out the present invention.

As shown in FIG. 7, the elastic outer face of the elastic bag structure 3*a* presses onto the inner surface of the cylindrical substrate 1 as a result of the introduction of the refrigerant, and then the cylindrical substrate 1 is held with the elastic bag structure 3*a*. Once the introduction of the refrigerant 8 is terminated, the elastic bag structure 3*a* is shrunk to the original shape, and then the cylindrical substrate 1 is removed from the temperature control unit.

Figure 8A:
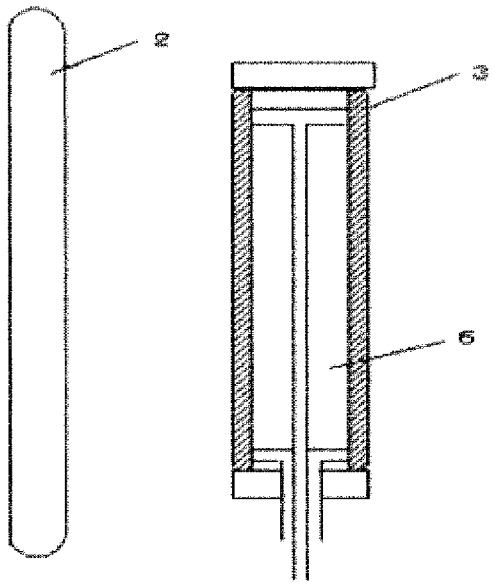
FIG. 8A is a schematic diagram showing a structural example of the temperature control unit which is suitable for carrying out the present invention (before the refrigerant is introduced).
Figure 8B:
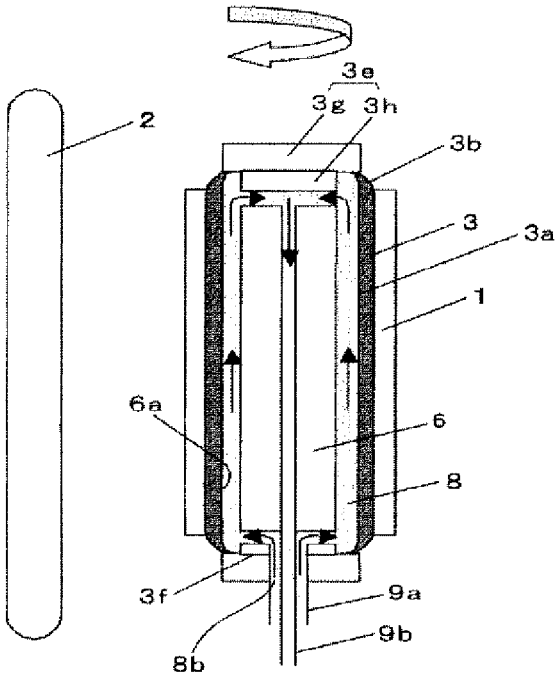
FIG. 8B is a schematic diagram showing a structural example of the temperature control unit which is suitable for carrying out the present invention (after the refrigerant is introduced).

As shown in FIGS. 8A and 8B, it is preferably that the bag structure 3*a* is a cylindrical bag structure having a circular through-hole 8*b* in its center, the cylindrical bag structure is disposed on the rigid structure 6 so that the inner circumference of the inner surface of the membrane member 3 contacts with the outer circumference of the surface of the rigid tube structure 6, and the refrigerant 8 is introduced in the unfixed part 6*a* (the space in between the outer circumference of the surface of the rigid tube 6 and the inner circumference of the inner surface of the membrane member 3). By fixing the membrane member around the rigid tube structure 6, the holding ability of the cylindrical substrate 1 is improved. In addition, the accuracy in the positioning is increased as the rigid tube structure 6 is disposed as a central axis. In the embodiment shown in FIG. 8, the double pipe of inner and outer pipes 9*a*, 9*b* is disposed in the circular through-hole 8*b*, and it is preferable that the pipe for the refrigerant (in the drawing, it is the outer pipe 9*a*, but the inner pipe 9*b* may be also set as the pipe for the refrigerant) is disposed and the refrigerant is introduced into and released from the pipe for the refrigerant.

The positioning of the location where the cylindrical substrate 1 is held with the cylindrical elastic body 6 is performed by using metal or resin disk pressing tools 3*e*, 3*f*. Note that, the top pressing tool 3*e* is comprised of a flange 3*g* and an inner cap 3*h*.

A thickness of the membrane member 3 of the cylindrical elastic body which contacts with the entire inner surface of the cylindrical substrate 1 is preferably 1.0 to 2.0 times of the thickness of the top and bottom parts of the membrane member 3 of the cylindrical elastic body at where the cylindrical substrate 1 is contacted. It is also preferable that the cross-section of the thickness changing part 3*b* of the membrane member 3 of the cylindrical elastic body is shaped in taper or curve.

Moreover, the bag structure 3*a* is, though it is not illustrated in the drawing, is a chuck which holds the cylindrical substrate 1 from the hollow space, and rotates so as to rotate the cylindrical substrate 1 while holding the same from the hollow space thereof.

Furthermore, the temperature control unit of the present invention includes the embodiment such that the refrigerant is circulated via a constant temperature water bath which controls the temperature, and then is re-introduced into the temperature control unit.

Figure 9:
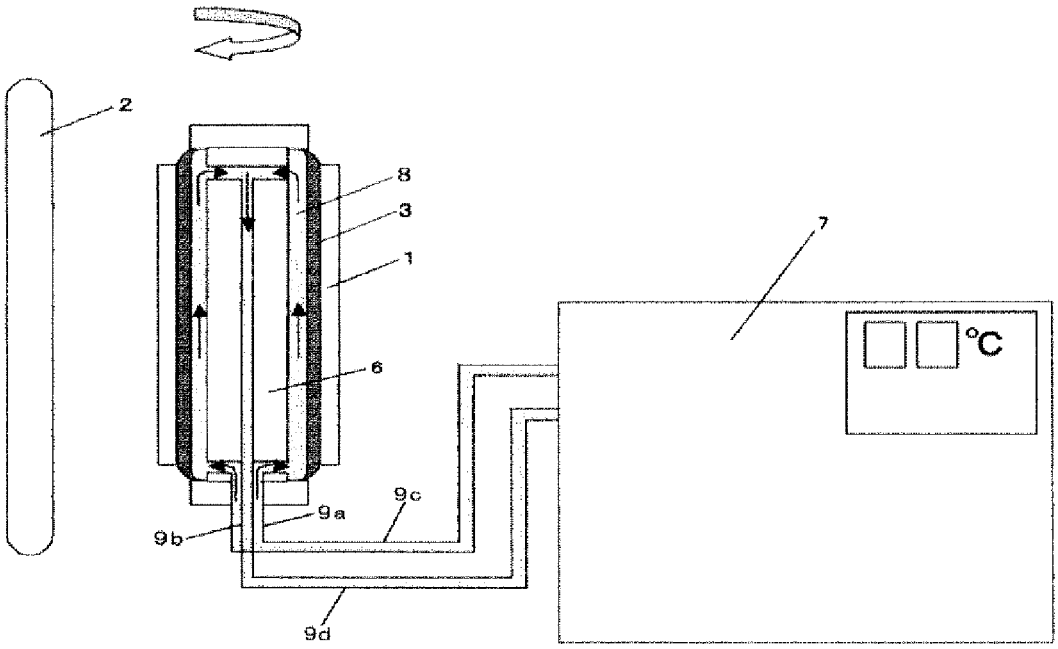
FIG. 9 is a schematic diagram showing a structural example of the temperature control unit which is suitable for carrying out the present invention.

The device shown in FIG. 9 illustrates one example of such the embodiment. Two cooling tubes 9*c*, 9*d*, are respectively extended from the double pipe 9*a*, 9*b*, and are connected to the constant-temperature water bath 7. As a result of that the refrigerant 8 returning from the temperature control unit is passed through the constant temperature water bath 7 and is re-introducing into the temperature control unit, the refrigerant having the controlled temperature can be circulated within the temperature control unit, the abrasion resistance and stable electric characteristics are attained. Among two cooling tube 9*c*, 9*d*, one of them is used as an outward path for introducing the refrigerant 8, and the other is used as a return path for releasing the refrigerant from the temperature control unit.

The temperature control unit of the present invention contains another embodiment such that the temperature control unit contains a pressure detector which monitors the pressure of the refrigerant 8, and a flow rate control unit wherein the liquid circulated inside of the membrane member 3 of the cylindrical elastic body as the refrigerant 8 is supplied from the refrigerant storage tank by means of a pump via a refrigerant supply pipe, and the refrigerant 8 is released into the refrigerant storage tank after circulating inside of the membrane member 3 of the cylindrical elastic body.

[Embodiment of Temperature Control Unit]

Figure 10:
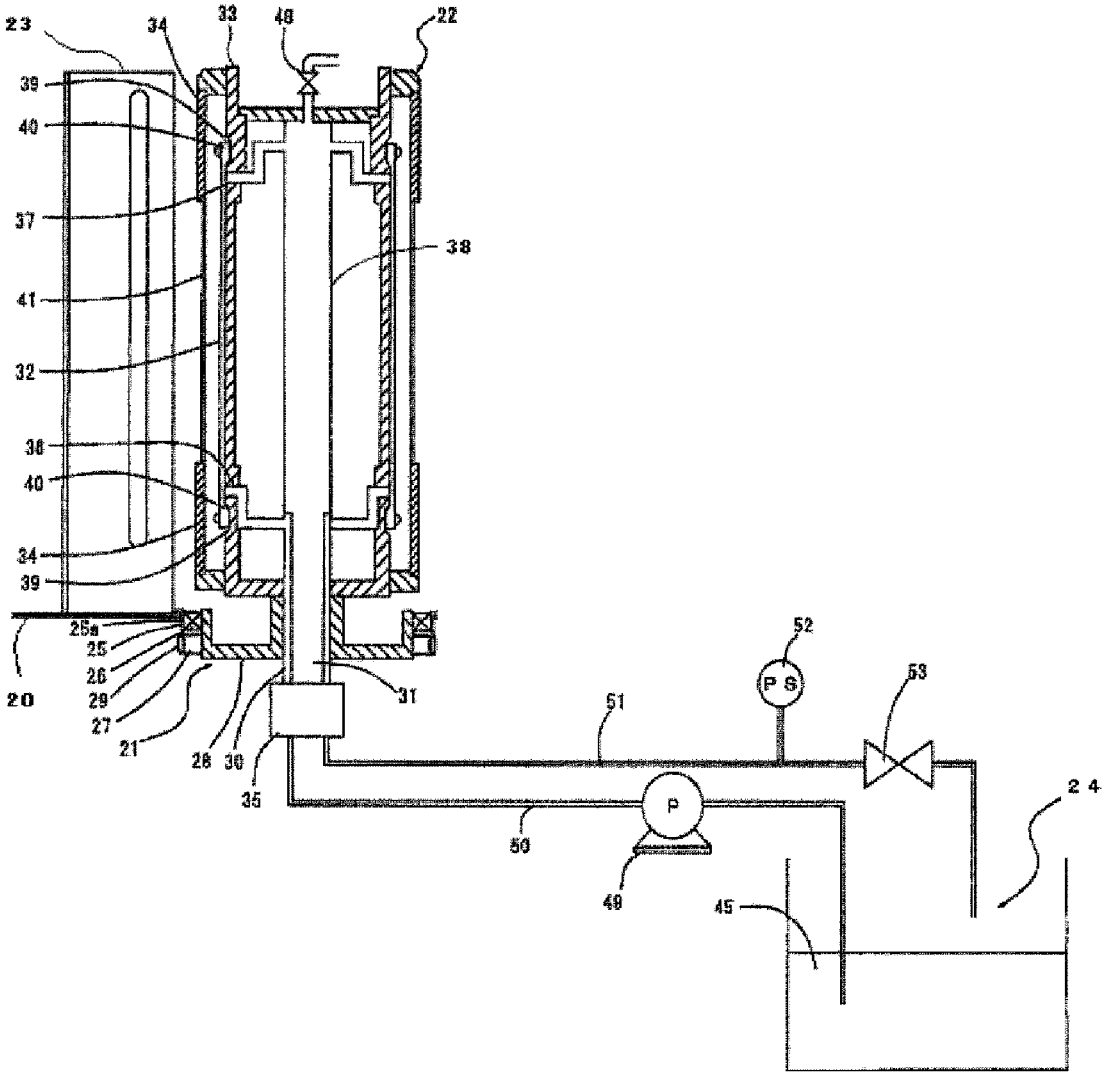
FIG. 10 is a diagram explaining an example of a schematic structure of the present invention.

Hereinafter, one embodiment of the present invention is explained with reference to the drawings. FIG. 10 is a cross-sectional plane view showing an example of a schematic structure of a temperature control unit for an electrophotographic photoconductor substrate in accordance with the present invention.

The embodiment of the temperature control unit for a part of the device such as the electrophotographic photoconductor is roughly classified into a device support 20, a rotation system 21 rotationally disposed in the centric area of the device support 20, a holding system 22 connected with the edge of the rotation system 21, a UV radiation system 23 disposed at the perimeter of the device support 20, and a refrigerant storage tank 24 connected with the holding system 22 by a pipe arrangement.

The rotation system 21 contains a flange 25, a hearing 26, a pulley 27 fitted with a bearing case which stores the bearing 26, a rotation axis 28, and a belt 29 suspended by the pulley 27. The flange 25 has an opening 25*a*, and the rotation axis 28 is disposed and rotationally supported in the opening 25*a* via the bearing 26. The pulley 27 is fixed to the rotation axis 28, the pulley 27 is connected with a driving means (which is not illustrated in the drawing) via the belt 29, and the driving force of the driving means is transmitted to the rotation axis 28.

The structure of the holding system 22 is roughly classified into the rotation axis 28, a refrigerant supplying pipe 30 and a refrigerant releasing pipe 31, a cylindrical elastic body 32, a cylindrical frame 33, and a cylindrical pressing tool 34. In the centric part of the rotation axis 28, the refrigerant releasing pipe 31 is passed through, and the end edge of the refrigerant releasing pipe 31 is connected with a rotational joint 35. The rotational joint 35 is configured to connect with two systems of the refrigerant, and the first system is used for supplying, and the second system is used for releasing. The end edge of the refrigerant releasing pipe 31 is connected with the second system for releasing. The refrigerant supplying pipe 30 connected with the first system for supplying is connected with the bottom circumferential side of the cylindrical frame 33. The cylindrical frame 33 has a hole 36 to which the refrigerant supplying pipe 30 is connected at the bottom circumferential side thereof, so that the refrigerant is supplied to the surface of the cylindrical frame 33. The cylindrical frame 33 has a hole 37 from which the refrigerant is recycled to the refrigerant releasing pipe 31 at the upper circumferential side thereof. The hole 37 and the refrigerant releasing pipe 31 are connected with a pipe 38.

The cylindrical elastic body 32 is disposed on the surface of the cylindrical frame 33. At the upper and bottom parts of the cylindrical frame 33, recesses 39 are formed so as to fix the cylindrical elastic body 32 thereto. In order to fix the edges 40 of the cylindrical elastic body 32 to the recesses 39, the upper part and bottom part of the cylindrical elastic body is configured to have a thickness of 1.0 to 2.0 times thicker than the thickness of the cylindrical elastic body 32 which is attached to the center part of the cylindrical frame 33. Therefore, the cylindrical elastic body 32 is easily located to the cylindrical frame 33 at the time of replacing the cylindrical elastic body 32. In addition, the cylindrical elastic body 32 is prevented from dislocation caused by the repeated use by replacing the cylindrical substrate 41 which is a work-piece.

Figure 11A:
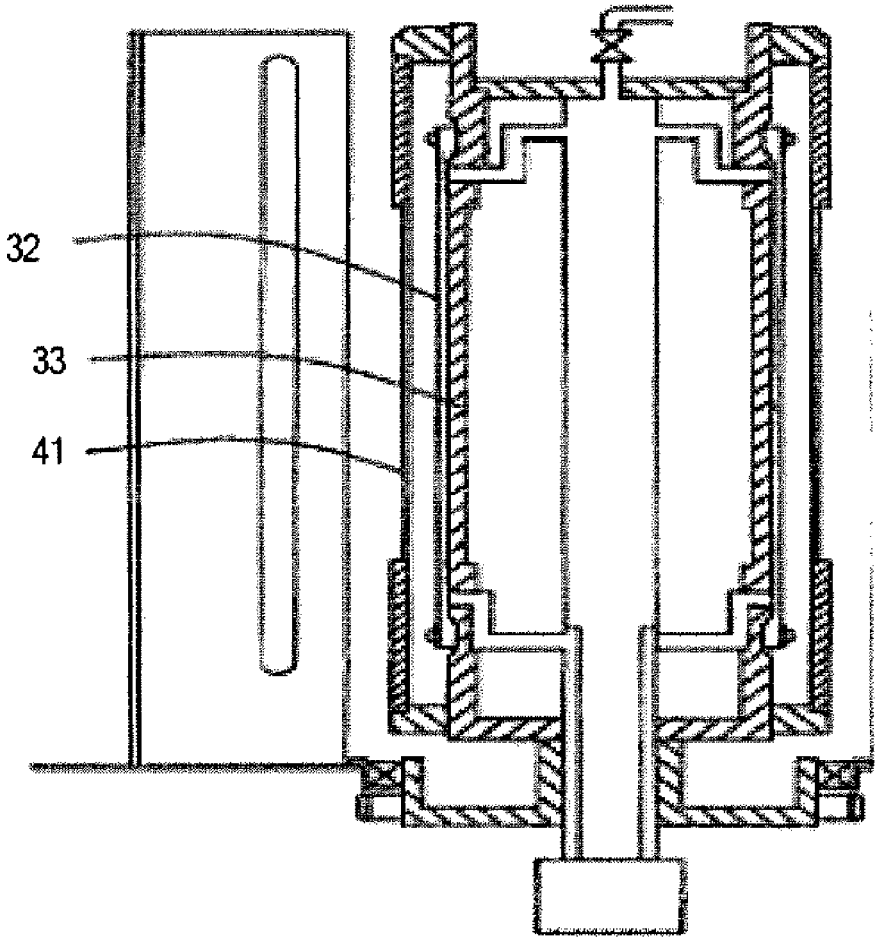
FIG. 11A and FIG. 11B are schematic diagrams showing examples of the state where the cylindrical substrate is held with the cylindrical elastic body.
Figure 11B:
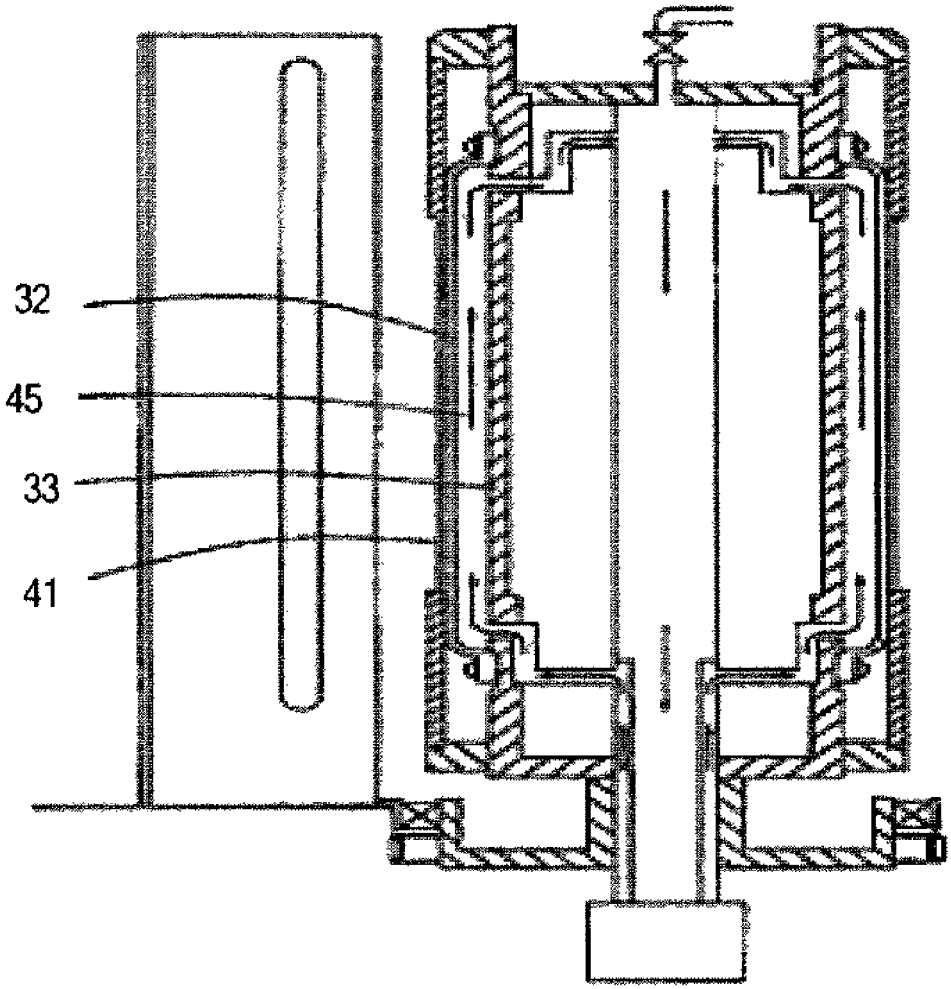

FIG. 11A shows the state where the cylindrical elastic body 32 is attached to the surface of the cylindrical frame 33. FIG. 11B shows the state where the cylindrical elastic body 32 holds the cylindrical substrate 41 which is a work-piece. The cylindrical substrate 41 is configured to be held by the swollenness of the cylindrical elastic body 32.

Figure 12:
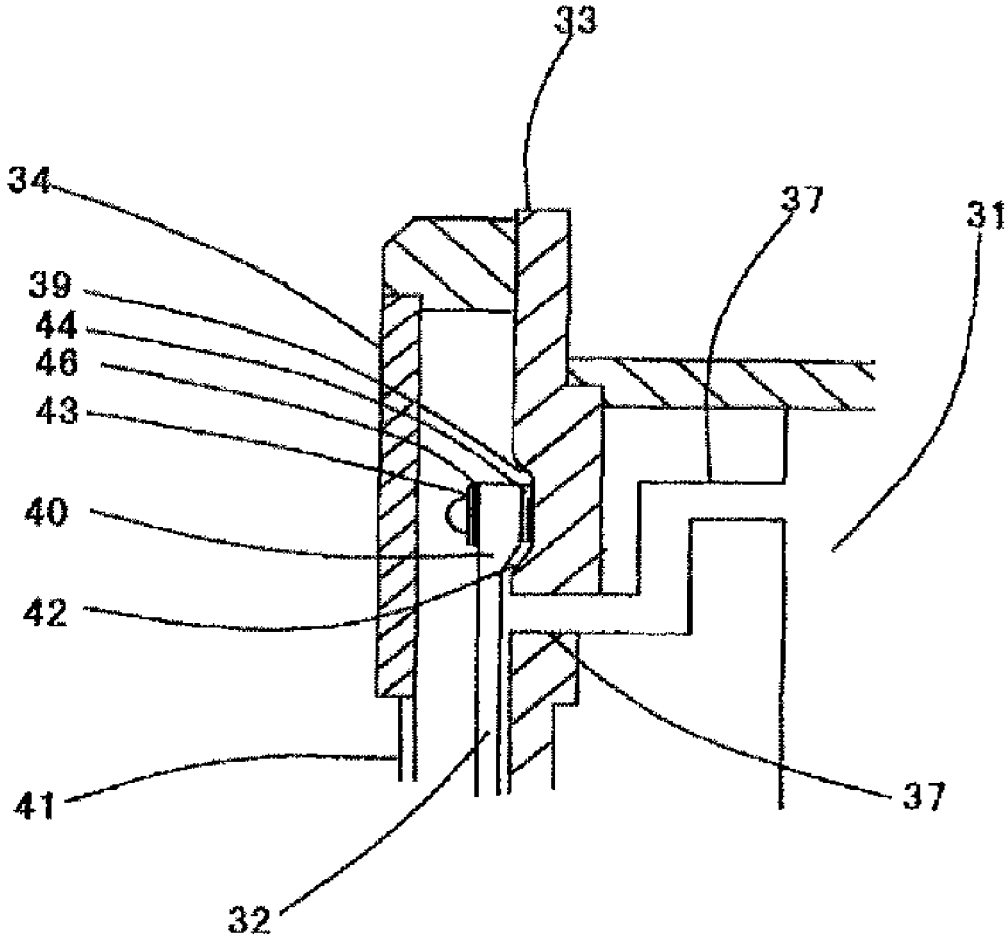
FIG. 12 is a schematic diagram showing an example of the installment of the cylindrical elastic body.

FIG. 12 shows a structural view in which the area around the edge 40 of the cylindrical elastic body 32 is enlarged. As shown in FIG. 12, a tilt 42 is formed between the recess 39 and the surface of the cylindrical frame 33. The thickness of the edge of the cylindrical elastic body 32 is formed with the gradient in the shape of taper or curve, along with the tilt 42. As a result of that the edge of the cylindrical elastic body 32 is shaped in the taper or curve, the edge 40 which changes its thickness is prevented from receiving the excessive stress at the time when the cylindrical elastic body 32 is stretched. Moreover, the surface of the tilt 42 is preferably mirror finished so as not to damage the cylindrical elastic body 32.

The cylindrical elastic body 32 is fixed at the upper and bottom parts thereof with stainless steel bands 43 for the purpose of easy replacement. A rubber ring 44 of self-bubble sponge is placed in between the surface of the cylindrical frame 33 and the cylindrical elastic body 32. As a result of the rubber ring 44, the refrigerant 45 filled in the cylindrical elastic body 32 and the cylindrical frame 33 is prevented from leaking. In the case where the cylindrical elastic body 32 is fasten by the stainless steel bands 43, a seamless rubber ring 46 is placed in between the stainless steel band 43 and the cylindrical elastic body 32 so as to protect the surface of the cylindrical elastic body 32.

The cylindrical elastic body 32 is stretched by the pressure of the refrigerant at the time when the refrigerant 45 is supplied from the refrigerant supplying pipe 30, so that the stretched cylindrical elastic body 32 is closely attached to the inner surface of the cylindrical substrate 41 and holds the cylindrical substrate 41. In this manner, the surface of the cylindrical substrate 41 is uniformly cooled.

The cylindrical substrate 41 is equipped with cylindrical pressing tools 34 formed of a metal or resin at the top and bottom parts thereof, so that the cylindrical substrate 41 is easily located in the up and down directions. Moreover, the cylindrical elastic body 32 is prevented from being exposed with the UV light during the heating process of the cylindrical substrate 41 by means of the UV radiation unit 23. Therefore, the cylindrical elastic body 32 is prevented from the deterioration due to the UV light. The cylindrical pressing tools 34 are movable up and down, and enables to cool the cylindrical substrates 41 having different sizes in the longitudinal direction.

After the termination of the heating of the cylindrical substrate 41, the supply of the refrigerant 45 from the refrigerant supplying pipe 30 to the space between the cylindrical elastic body 32 and the elastic frame 33 is terminated. When the supply of the refrigerant 45 is terminated, the pressure of the refrigerant 45 is reduced so that the cylindrical elastic body 32 is shrunk and closely attached to the surface of the cylindrical frame 33. At this time, the inner diameter of the cylindrical elastic body 32 is smaller than the outer diameter of the cylindrical frame 33 so that the refrigerant 45 is recycled into the cylindrical frame 33.

Moreover, the air release valve 48 is disposed at the top part of the refrigerant releasing pipe 31 so as to prevent the generation of bubbles in the refrigerant 45 at the time when the refrigerant 45 is supplied into the space between the cylindrical elastic body 32 and the cylindrical frame 33. The air release valve 48 is opened for a certain period at the time of supplying the refrigerant 45.

In the refrigerant storage tank 24 connected to the holding system 22 via the pipe arrangement, the refrigerant 45 is stored, and is passed to the rotational joint 35 disposed at the bottom part of the holding system 22 via a pipe 50 by means of a pump 49. The refrigerant 45 released from the rotational joint 35 of the holding system 22 is returned to the refrigerant storage tank 24 via a pipe 51. The pipe 51 is equipped with a pressure censer 52 which monitors the pressure of the refrigerant 45, and a valve 53 which controls the flow rate of the refrigerant 45. In the heating process of the cylindrical substrate 41 by means of the UV radiation system 23, once the sensor 52 recognizes the drop in the pressure, the pressure error signal is transmitted to a control device which is not illustrated in the drawing, and then the device is stopped. This is because that the drop in the pressure of the refrigerant 45 released from the holding system 22 is considered to be an occurrence of a leak of the refrigerant 45 due to a breakage of the cylindrical elastic body 32. In this manner, the pressure state of the refrigerant 45 released from the holding system 22 can be used for a monitoring of the device. Moreover, the internal pressure in the space between the cylindrical elastic body 32 and the cylindrical frame 33 is controlled by operating the valve 53 which controls the flow rate of the refrigerant 45, and the holding force of the cylindrical substrate 41 is arbitrarily adjusted.

Figure 13:
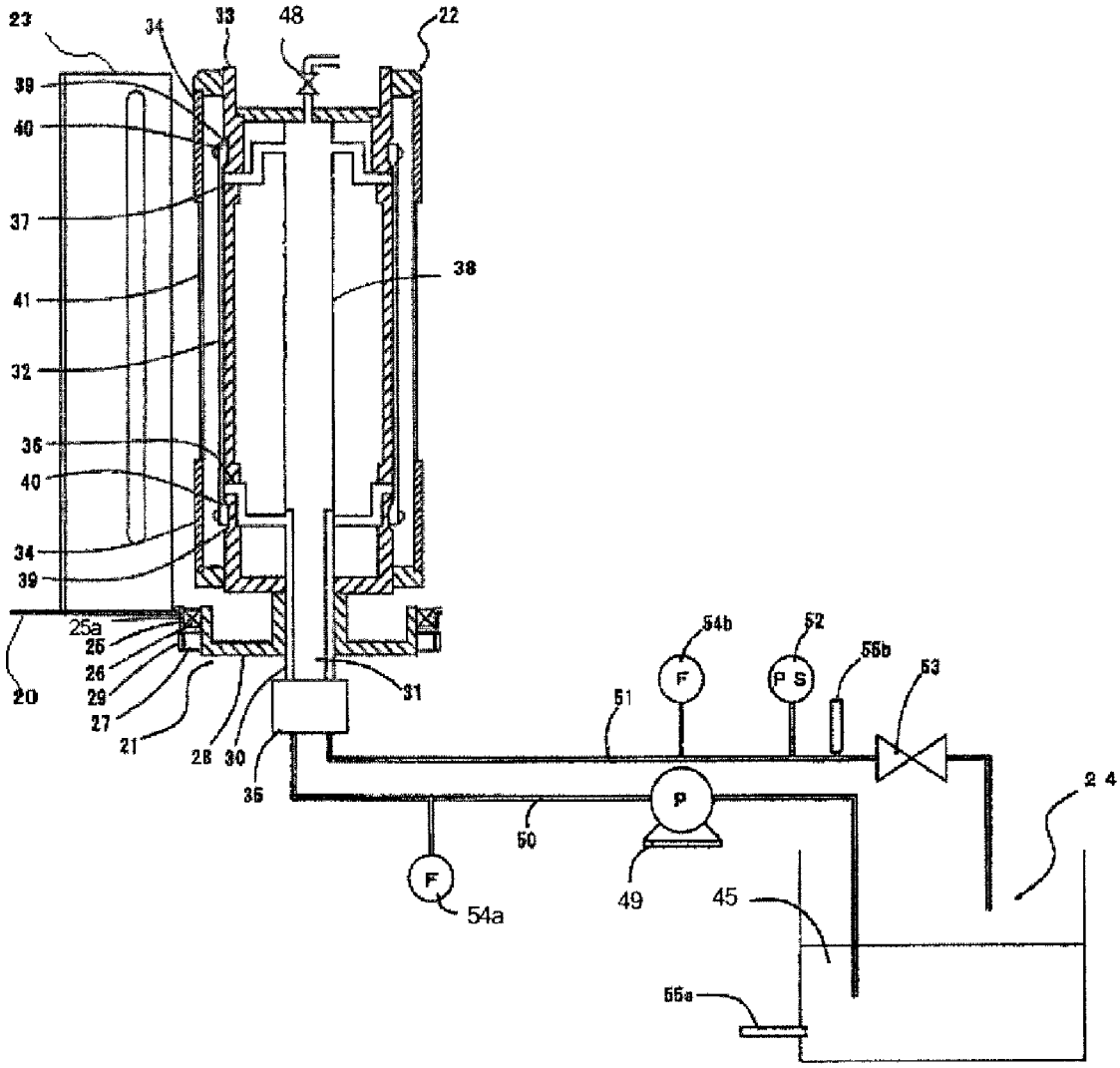
FIG. 13 is a cross-sectional view of an example of an electrophotographic photoconductor for use in the present invention.

As a modified embodiment, the pipe 50 is equipped with a flow meter 54*a* and the pipe 51 is equipped with a flow meter 54*b* as shown in FIG. 13, the leak of the refrigerant 45 due to the breakage of the cylindrical elastic body 32 can be detected by detecting the difference in the flow rates of the pipe 50 and the pipe 51.

Moreover, the refrigerant storage tank 24 is equipped with a thermometer 55*a*, the pipe 51 is equipped with a thermometer 55*b*, and then the cooling efficiency of the cylindrical substrate 41 by means of the cylindrical elastic body 32 can be detected by detecting a difference in the temperature of the refrigerant in the refrigerant storage tank 24 and the temperature of the refrigerant in the pipe 51. In addition, the detected value of the temperature deference is continuously recorded in the control device which is not illustrated in the drawing, and the variation of the temperature with time can be detected from the beginning of the production. This variation of the temperature with time is corresponded to the variation of the light quantity of the UV lamp or the like used for the UV radiation system 23, the timing for replacing the UV lamp or the like can be detected as when the variation of the temperature with time is exceeded at a certain threshold.

The material used for the cylindrical elastic body 32 is preferably selected from the material having excellent water resistance, and abrasion resistance. Specific examples thereof include ethylene-propylene-diene rubber, and the like.

[Layer Structure of an Electrophotographic Photoconductor]

The electrophotographic photoconductor for use with the present invention will be described with reference to the drawings.

FIGS. 14A and 14B are cross-sectional views of the electrophotographic photoconductor, and said photoconductor has a single-layered structure wherein, on a conductive substrate 11, a photoconductive layer 12 having the both charge generating function and charge transporting function is disposed. FIG. 14A shows the case where the crosslinked surface layer 13 constitutes the entire photoconductive layer 12. FIG. 14B shown the case where the crosslinked surface layer 13 constitutes a surface portion of the photoconductive layer 12.

FIGS. 15A and 15B are cross-sectional views of the electrophotographic photoconductor, and said photoconductor has a laminate-layered structure wherein, on a conductive substrate 11, a charge generating layer 12*a* having the charge generating function and a charge transporting layer 12*b* having the charge transporting function are disposed. FIG. 15A shows the case where the crosslinked surface layer 13 constitutes the entire charge transporting layer 12*b*. FIG. 15B shown the case where the crosslinked surface layer 13 constitutes a surface portion of the charge transporting layer 12*b*.

[Conductive Substrate]

The conductive substrate is suitably selected depending on the intended purpose without any restrictions, provided that it has a conductivity and volume resistance of $10^{10}$ Ω·cm or less. Examples thereof include a film of or cylindrical plastic or paper to which metal oxide, e.g. aluminum, nickel, chrome, nichrome, cupper, gold, silver, platinum, etc., is deposited by sputtering, a tube which is prepared by extruding a plate of aluminum, aluminum alloy, nickel, stainless steel, or the like, shaping into a tube in accordance with a method such as a drawing or the like, and subjected to a surface treatment such as cutting, super finishing, polishing or the like. Moreover, the nickel endless belt and stainless steel endless belt disclosed in JP-A No. 52-36016 are also used as the conductive substrate.

Furthermore, those prepared by dispersing conductive powder in a binder resin and coating the same on the substrate can be also used as the conductive substrate.

Examples of the conductive powder include carbon black, acetylene black, metal powder of aluminum, nickel, iron, nichrome, copper, zinc, silver or the like, and metal oxide powder of conductive tin oxide, ITO, or the like. Examples of the binder resin used at the same time include thermoplastic resins, thermoset resins, or photocuring resins, such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinyl carbazole, acrylic resin, silicone resin, epoxy resin, melamine resin, urethane resin, phenol resin, alkyd resin, and the like. Such the conductive layer is disposed, for example, by dispersing the aforementioned conductive powder and binder resin in a suitably selected solvent, e.g. tetrahydrofuran, dichloromethane, methylethylketone, toluene, or the like, and coating the solution.

Moreover, the one in which a conductive layer formed from a thermal contraction tube is disposed on an appropriate cylindrical substrate can also be suitably used as the conductive substrate. Here, the thermal contraction tube is formed of a material, such as polyvinyl chloride, polypropylene, polyester, polystyrene, polyvinylidene chloride, polyethylene, chloride rubber. Teflon (registered trade mark), or the like, containing the conductive powder therein.

[Photoconductive Layer]

The photoconductive layer will be explained next. The photoconductive layer may have a single-layered structure or laminate-layered structure.

In the case where the photoconductive layer has a laminate-layered structure, the photoconductive layer is comprised of a charge generating layer having a charge generating function, and a charge transporting layer having a charge transporting function. In the case where the photoconductive layer has a single-layered structure, the photoconductive layer is a layer which has the charge generating function and the charge transporting function at the same time.

Hereinafter, the laminate-layered photoconductive layer and single-layered photoconductive layer will be explained.

[Laminate-layered Photoconductive Layer]

(Charge Generating Layer)

The charge generating layer contains a charge generating compound having a charge generating function, as a main component, and optionally contains a binder resin in combination, if necessary. As the charge generating compound, an inorganic material and an organic material are used.

Examples of the inorganic material include crystalline selenium, amorphous selenium, selenium-tellurium, selenium-tellurium-halogen, selenium-arsenic compound, amorphous silicon, and the like. The preferable example of the amorphous selenium is the one in which a dangling-bond is terminated with a hydrogen atom and/or a halogen atom, or the one doped with a boron atom, a phosphorous atom, or the like.

As the organic material, the known materials in the art can be used. Examples thereof include phthalocyanine pigments such as metal phthalocyanine and metal-free phthalocyanine, azulenium salt pigments, squaric acid methyne pigments, azo pigments having a carbazole skeleton, azo pigments having a triarylamine skeleton, azo pigments having a diphenylamine skeleton, azo pigments having a fluorenone skeleton, azo pigments having an oxadiazole skeleton, azo pigments having a bisstilbene skeleton, azo pigments having a distyryl oxadiazole skeleton, azo pigments having a distyryl carbazole skeleton, perylene pigments, anthraquinone or polycyclic quinone pigments, quinone imine pigments, diphenylmethane and triphenylmethane pigments, benzoquinone and naphthoquinone pigments, cyanine and azomethine pigments, indigoid pigments, bisbenzimidazole pigments, and the like. Each of these charge generating compounds may be used singly or in combination of two or more.

Examples of the optionally used binder resin include polyamide, polyurethane, epoxy resin, polyketone, polycarbonate, silicone resin, acrylic resin, polyvinyl butyral, polyvinyl formal, polyvinyl ketone, polystyrene, poly-N-vinylcarbazole, polyacrylamide, polyvinylbenzal, and the like. Each of these binder resins may be used singly or in combination with two or more. Other than the aforementioned binder resins as the binder resin of the charge generating layer, a macromolecular charge transporting compound having a charge generating function can be used. Examples of such the macromolecular charge transporting compound include: polycarbonate, polyester, polyurethane, polyether, polysiloxane, acrylic resin, each of which has an aryl amine, benzidine, hydrazone, carbazole, stilbene, or pyrazoline structure therein; and polymeric material having a polysilane structure.

The specific examples of the aforementioned former example are charger transporting polymeric materials disclosed in JP-A Nos. 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-239049, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, 09-328539, and the like.

Moreover, the specific examples of the aforementioned latter example are polysilylene polymers disclosed in JP-A Nos. 63-285552, 05-19497, 05-70595, 10-73944, and the like.

Furthermore, the charge generating layer may further contain a low molecular charge transporting compound.

The low molecular charge transporting compound which can be used in the charge generating layer is classified into a hole transporting material and an electron transporting material.

Examples of the electron transporting material include electron receiving compounds such as chrolanil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, 1,3,7-trinitrobenzothiophene-5,5-dioxide, diphenoquinone derivative, and the like. These are used singly or in combination of two or more, as the electron transporting material.

As the hole transporting material, the electron donating compounds listed below can be suitably used. Specifically, examples of the hole transporting material include oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, other materials known in the art, and the like. These are used singly or in combination of two or more, as the hole transporting material.

The forming method of the charge generating layer is roughly classified into a vacuum thin film forming method, and a casting method using dispersion solution.

Specific examples of the vacuum thin film forming method include a vapor deposition method, a glow discharge decomposition method, an ion-plating method, a sputtering method, a reactive sputtering method, CVD method, and the like. In the aforementioned methods, the layer of the aforementioned inorganic or organic material can be suitably formed.

In the case where the charge generating layer is formed in accordance with the aforementioned casting method, the aforementioned inorganic or organic charge generating compound is dispersed, if necessary together with a binder resin, in a solvent such as tetrahydrofuran, dioxane, dioxolane, toluene, dichloromethane, monochlorobenzene, dichloroethane, cyclohexane, cyclopentanone, anisole, xylene, methylethylketone, acetone, ethyl acetate, butyl acetate, or the like, by means of a ball mill, attritor, sand mill, bead mill, or the like, and then the dispersion is appropriately diluted and coated to thereby form the electron generating layer. If necessary, a leveling agent, e.g. dimethyl silicone oil, methylphenyl silicone oil, etc., can be added thereto. The coating is carried out in accordance with a dip coating method, spray coating method, bead coating method, ring coating method, or the like.

The charge generating layer prepared in the manner mentioned above has a thickness of 0.01 μm to 5 μm, preferably 0.05 μm to 2 μm.

[Charge Transporting Layer]

The charge transporting layer is a layer having a charge transporting function, and a crosslinked surface layer having a charge transporting structure is effectively used as the charge transporting layer. In the case where the crosslinked surface layer is the entire charge transporting layer, the crosslinked surface layer is formed by coating, on the charge generating layer, a coating solution containing a radical polymerization compound (a radical polymerizable monomer having no charge transporting structure and a radical polymerizable monomer having a charge transporting structure; hereinafter, the radical polymerization compound denotes the same definition) and filler, optionally drying the coated layer, and externally imparting an energy so as to initiate a curing reaction. A thickness of the crosslinked surface layer has a thickness of 10 μm to 30 μm, preferably 10 μm to 25 μm. When the thickness thereof is thinner than 10 μm, a sufficient charging potential cannot be maintained. When the thickness thereof is thicker than 30 μm, the crosslinked surface layer tends to be separated from an under layer due to a volume contraction at the time of curing.

In the case where the crosslinked surface layer is formed at a surface portion of the charge transporting layer and the charge transporting layer is of laminate-layered structure, the bottom part of the charge transporting layer is formed by coating, on the charge generating layer, a solution in which a charge transporting compound having a charge transporting function and a binder resin are dissolved and/or dispersed in an appropriate solvent, and drying the coated solution, and then a top part of the charge transporting layer is formed by coating, on the thus formed bottom layer, a coating solution containing a radical polymerizable compound and filler, and crosslinking and curing the coated layer by the application of external energy.

As the charge transporting compound, the electron transporting materials, hole transporting materials, and macromolecular charge transporting materials listed in the descriptions of the aforementioned charge generating layer can be used. The use of the macromolecular charge transporting material is effective as the solubility of the bottom layer is suppressed at the time of coating the surface layer.

Examples of the binder resin include thermoplastic or thermoset resins such as polystyrene, styrene-acrylonitril copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyacrylate resin, phenoxy resin, polycarbonate, cellulose acetate resin, ethyl cellulose resin, polyvinyl butyral, polyvinyl formal, polyvinyl toluene, poly-N-vinyl carbazole, acrylic resin, silicone resin, epoxy resin, melamine resin, urethane resin, phenol resin, alkyd resin, and the like.

The amount of the charge transporting compound is 20 parts by mass to 300 parts by mass, and preferably 40 parts by mass to 150 parts by mass, with respect to 100 parts by mass of the binder resin. Note that, in case where the macromolecular charge transporting material is used, it can be used alone, or in combination with the binder resin.

As the solvent used for coating of the bottom part of the charge transporting layer, the one similar to the solvent used for the charge generating layer can be used, but suitable examples thereof are the ones dissolves the charge transporting compound and the binder resin well. Here, a single solvent or mixed solvent of two or more is used. Moreover, the bottom part of the charge transporting layer is formed in accordance with a coating method similar to the coating method of the charge generating layer.

The bottom part of the charge transporting layer may optionally contain a plasticizer and a leveling agent.

As the plasticizer used in the bottom part of the charge transporting layer, the conventional plasticizers for resin such as dibutyl phthalate, dioctyl phthalate, and the like can be used. The usage amount thereof is appropriately 0 to 30 parts by mass with respect to 100 parts by mass of the binder resin.

As the leveling agent used in the bottom part of the charge transporting layer, silicone oil such as dimethyl silicone oil, methylphenyl silicone oil and the like, and polymer or oligomer having a perfluoroalkyl group at a side chain thereof can be used. The usage amount thereof is appropriately 0 to 1 part by mass with respect to 100 parts by mass of the binder resin.

A thickness of the bottom part of the charge transporting layer is appropriately 5 μm to 40 μm, and preferably 10 μm to 30 μm.

In the case where the crosslinked surface layer is the entire charge transporting layer, as mentioned in the forming method of the crosslinked surface layer, the crosslinked surface layer is formed by coating a coating, on the bottom part of the charge transporting layer, a coating solution containing a radical polymerizable compound, optionally drying the coated layer, and externally imparting an energy such as heat or light so as to initiate a curing reaction. A thickness of the crosslinked surface layer is 1 μm to 20 μm, and preferably 2 μm to 10 μm. When the thickness thereof is thinner than 1 μm, the durability is varied due to the uneven film thickness. When the thickness thereof is thicker than 20 μm, the reproducibility is declined due to the diffusion of the charge as the film thickness of the entire charge transporting layer becomes large.

[Single-layered Photoconductive Layer]

The photoconductive layer of a single-layered structure is a layer having both the charge generating function and charge transporting function at the same time. The crosslinked surface layer having the charge transporting structure is effectively used as a single-layered photoconductive layer by adding therein a charge generating compound having a charge generating function. As mentioned in the casting method for forming the charge generating layer, the crosslinked surface layer is formed by dispersing the charge generating compound in the coating solution containing the radical polymerizable compound, coating the coating solution on the substrate, optionally drying the coated layer, and externally imparting energy so as to initiate a curing reaction. Note that, a dispersion solution in which the charge generating compound is dispersed in a solvent can be added to the coating solution of the crosslinked surface layer. A thickness of the crosslinked surface layer is 10 μm to 30 μm, and preferably 10 μm to 25 μm. When the thickness thereof is thinner than 10 μm, the sufficient charging potential cannot be maintained. When the thickness thereof is thicker than 30 μm, the crosslinked surface layer tends to be separated from an under layer due to a volume contraction at the time of curing.

In the case where the crosslinked surface layer is a top part of the single-layered photoconductive layer, the bottom part of the single-layered photoconductive layer is formed by dissolving and/or dispersing the charge generating compound having a charge generating function, the charge transporting compound having a charge transporting function and the binder resin in an appropriate solvent, coating the thus prepared solution, and drying the coated layer, necessary, additives such as a plasticizer, a leveling agent, or the like can be added thereto. The dispersing method, the charge generating compound, the charge transporting compound, the plasticizer, and the leveling agent are the same as those described in the descriptions of the charge generating layer and the charge transporting layer. As the binder resin, the binder resin listed in the descriptions of the charge generating layer can be mixed for use other than the binder resin listed in the descriptions of the charge transporting layer. Moreover, the aforementioned macromolecular charge transporting compound can be also used, and the use thereof is effective as the components of the lower photoconductive layer in the crosslinked surface layer can be suppressed. A thickness of the bottom part of the photoconductive layer is appropriately 5 μm to 30 μm, and preferably 10 μm to 25 μm.

In the case where the crosslinked surface layer is a top part of the single-layered photoconductive layer, the crosslinked surface layer is formed by coating, on the aforementioned bottom part of the photoconductive layer, a coating solution containing the radical polymerizable compound and the charge generating compound, optionally drying the coated layer, and curing the coated layer by externally imparting energy such as heat or light. The thickness of the crosslinked surface layer is 1 μm to 20 μm, and preferably 2 μm to 10 μm. When the thickness thereof is thinner than 1 μm, the durability is varied due to the uneven film thickness.

The amount of the charge generating compound contained in the single-layered photoconductive layer is preferably 1% by mass to 30% by mass with respect to the total mass of the photoconductive layer. The preferable amounts of the binder resin and the charge transporting compound contained in the bottom part of the photoconductive layer are respectively 20% by mass to 80% by mass and 10% by mass to 70% by mass with respect to the total amount of the bottom part of the photoconductive layer.

[Intermediate Layer]

In the case where the crosslinked surface layer is a top part of the photoconductive layer, an intermediate layer can be disposed in the photoconductor for use in the present invention for the purpose of preventing the contamination of the components of the bottom layer in the crosslinked surface layer and improving the adherence between the crosslinked surface layer and the layer below. The intermediate layer prevents any inhibition of the curing reaction and formation of uneven surface of the crosslinked surface layer, which are cased by the contamination of the components of the bottom part of the photoconductive layer in the outermost surface layer containing the radical polymerizable compound. Moreover, the intermediate layer also improves the adherence between the bottom part of the photoconductive layer and the crosslinked surface layer.

The intermediate layer generally contains a hinder resin as a main component. Examples of the hinder resin include poly-amide, alcohol-soluble nylon, water-soluble polyvinyl butyral, polyvinyl butyral, polyvinyl alcohol, and the like. A formation method of the intermediate layer is selected from the aforementioned conventional coating method. A thickness of the intermediate layer is appropriately 0.05 μm to 2 μm.

[Undercoat Layer]

In the photoconductor for use in the present invention, an undercoat layer may be formed in between the conductive substrate and the photosensitive layer.

The undercoat layer generally contains a resin as the main component, however, in consideration that the undercoat layer is coated with the photosensitive layer using a solvent, it is preferable to use a resin having high resistance to typically used organic solvents.

Examples of such resin include: water-soluble resins such as polyvinyl alcohol, casein and sodium polyacrylate; alcohol soluble resins such as nylon copolymer and methoxymethylated nylon; and curable resins capable of forming a three-dimensional network structure such as polyurethane, melamine resin, phenol alkyl-melamine resin and epoxy resin. Moreover, to the undercoat layer, a fine powder pigment of metal oxide can be added to prevent occurrence of moiré and reduce the residual potential, etc. Examples of the metal oxide include titanium oxide, silica, alumina, zirconium oxide, tin oxide, indium oxide, and the like.

The undercoat layer can be formed by using an appropriate solvent and the coating method as described in the photosensitive layer. Moreover, a silane coupling agent, a titanium coupling agent, a chrome coupling agent, or the like can be added to the undercoat layer. Besides the above, for the undercoat layer used in the present invention, it is preferable to use a layer formed by anodically-oxidizing $Al_2O_3$ or a layer formed using an organic material such as polyparaxylylene (parylene) and an inorganic material such as $SiO_2$, $SnO_2$, $TiO_2$, ITO and $CeO_2$ by vacuum thin-layer forming method. Besides the material described above, conventional undercoat layers can be used. The thickness of the undercoat layer is appropriately 0 μm to 5 μm.

[Addition of Antioxidant in Each Layer]

The antioxidant may be added in each layer such as the crosslinked surface layer, charge generating layer, charge transporting layer, undercoat layer, intermediate layer and the like, for the purpose of improving whether resistance, especially for preventing decline of the sensitivity and increase of the residual potential.

Examples of the antioxidant are as listed below:

(Phenol Compound)

Examples of the phenol compound include; 2,6,-di-t-butyl-p-crezole; buthylated hydroxyanisole; 2,6-di-t-butyl-4-ethylphenol; stearyl-β-(3,5-di-t-butyl-4-hydroxyphenyl)propionate; 2,2'-methylene-bis-(4-methyl-6-t-butylphenol); 2,2'-methylene-bis-(4-ethyl-6-t-butylphenol); 4,4'-thiobis-(3-methyl-6-t-butylphenol); 4,4'-butylidenebis-(3-methyl-6-t-butylphenol); 1,1,3-tris-(2-methyl-4-hydroxy-5-t-butyphenyl)butane; 1,3,5-trimethyl-2,4,6-tris(3,5-di-t-butyl-4-hydroxybenzyl)benzene; tetrakis-[methylene-3-(3',5'-di-t-butyl-4'-hydroxyphenyl)propionate]methane; bis[3,3'-bis(4'-hydroxy-3' t-butylphenyl)butylic acid]glycol ester; tocopherol; and the like.

(Paraphenylene Diamine)

Examples of paraphenylenediamine include: N-phenyl-N'-isopropyl-p-phenylenediamine; N,N'-di-sec-butyl-p-phenylenediamine; N-phenyl-N-sec-butyl-p-phenylenediamine; N,N'-di-isopropyl-p-phenylenediamine; N,N'-dimethyl-N, N'-di-t-butyl-p-phenylenediamine; and the like.

(Hydroquinone)

Examples of hydroquinone include: 2,5-ji-t-octylhydroquinone; 2,6-didodecylhydroquinone; 2-dodecylhydroquinone; 2-dodecyl-5-chlorohydroquinone; 2-t-octyl-5-methylhydroquinone; 2-(2-octadecenyl)-5-methylhydroquinone; and the like.

(Organic Sulfur Compound)

Examples of the organic sulfur compound include: dilauryl-3,3'-thiodipropionate; distearyl-3,3'-thiodipropionate; ditetradecyl-3,3'-thiodipropionate; and the like.

(Organic Phosphorus Compound)

Examples of the organic phosphorus compound include: triphenyl phosphine; tri(nonylphenyl)phosphine; tri(dinonylphenyl)phosphine; tricresyl phosphine; tri(2,4-dibutylphenoxy)phosphine; and the like.

These compounds are known as a antioxidant for rubber, plastic, oil, or the like, and can be obtained as a commercial product.

The addition amount of the antioxidant is 0.01% by mass to 10% by mass with respect to the total amount of the layer to be added.

[Crosslinked Surface Layer]

The aforementioned radical polymerizable monomer having no charge transporting structure is a tri- or more functional radical polymerizable monomer having no charge transporting structure. The tri or more functional radical polymerizable monomer denotes a monomer which has no charge transporting structure such as a hole transporting structure (e.g. triaryl amine, hydrazone, pyrrazoline and/or carbazol) and an electron transporting structure (e.g. condensated polycyclic quinone, diphenoquinone, and an electron attractive aromatic ring having a cyano group and/or a nitro group), but has three or more functional radical polymerizable groups. The radical polymerizable functional group is suitably selected without any restrictions, provided that it has a C—C double bond, and is radically polymerizable. Examples of the radical polymerizable functional group include (1) 1-substituted ethylene functional group, (2) 1,1-substituted ethylene functional group, and the like.

Examples of (1) 1-substituted ethylene functional group include the functional group represented by the following formula:

$$CH_2{=}CH{-}X_2{-} \qquad \text{Formula (I)}$$

In the above formula, $X_2$ denotes an arylene group (e.g., phenylene and naphthylene) which may have a substituent; alkenylene group which may have a substituent; —CO— group; —COO— group; —CON($R_{36}$)— group (wherein $R_{36}$ represents a hydrogen atom; alkyl group (e.g., methyl and ethyl); aralkyl group (e.g., benzyl, naphthylmethyl and phenethyl); aryl group (e.g., phenyl and naphthyl)); or —S— group.

Examples of the substituent include a vinyl group, styryl group, 2-methyl-1,3-butadienyl group, vinylcarbonyl group, acryloyloxy group, acryloylamino group and vinylthioether group.

Examples of (2) 1,1-substituted ethylene functional group include a functional group represented by the following formula:

$$CH_2{=}C(Y_4){-}X_3{-} \qquad \text{Formula (II)}$$

In the above formula, $Y_4$ denotes an alkyl group which may have a substituent; aralkyl group which may have a substituent; aryl group (e.g., phenyl and naphthyl) which may have a substituent; halogen atom; cyano group; nitro group; alkoxy group (e.g. methoxy and ethoxy); and —$COOR_{37}$ group ((wherein $R_{37}$ represents a hydrogen atom; alkyl group (e.g., methyl and ethyl) which may have a substituent; aralkyl group (e.g., benzyl and phenethyl) which may have a substituent; aryl group (e.g., phenyl and naphthyl) which may have a substituent; or —$CONR_{38}R_{39}$ group (wherein $R_{38}$ and $R_{39}$, which may be identical or different, each denotes a hydrogen atom; alkyl group (e.g., methyl and ethyl) which may have a substituent; aralkyl group (e.g. benzyl, naphthylmethyl and phenethyl) which may have a substituent; or aryl group (e.g., phenyl and naphthyl) which may have a substituent)); and $X_3$ denotes any one of the groups described in relation to $X_2$, single bond, or alkylene group; with the proviso that at least one of $Y_4$ and $X_3$ is an oxycarhonyl group, cyano group, alkenylene group or aromatic ring group.

Examples of the substituent include an α-chloroacryloyloxy group, methacryloyloxy group, α-cyanoethylene group, α-cyanoacryloyloxy group, α-cyanophenylene group and methacryloylamino group.

Examples of substituent which further substitutes the substituent of groups represented by $X_2$, $X_3$ and $Y_4$ include a halogen atom; nitro group; cyano group; alkyl group (e.g., methyl and ethyl); alkoxy group (e.g., methoxy and ethoxy); aryloxy group (e.g., phenoxy); aryl group (phenyl and naphthyl); and aralkyl group (e.g., benzyl and phenethyl).

Among these radical-polymerizable functional groups, an acryloyloxy group and a methacryloyloxy group are particularly preferred. A compound having three or more acryloyloxy groups can be produced, for example, by esterifying or transesterifying a compound having three or more hydroxyl groups in the molecule with an acrylic acid (salt), an acrylic halide or an acrylate. A compound having three or more methacryloyloxy groups can be produced in the similar manner. Notably, in the three or more radical-polymerizable functional groups-containing monomer, radical-polymerizable functional groups may be identical or different.

The tri- or more functional radical-polymerizable monomer having no charge transportable structure is appropriately selected depending on the intended purpose without any restrictions. Examples thereof include trimethylolpropane triacrylate (TMPTA), trimethylolpropane trimethacrylate, HPA-modified trimethylolpropane triacrylate, EO-modified trimethylolpropane triacrylate, PO-modified trimethylolpropane triacrylate, caprolactone-modified trimethylolpropane triacrylate, HPA-modified trimethylolpropane triacrylate, pentaerythritol triacrylate, pentaerythritol tetraacrylate (PETTA), glycerol triacrylate, ECH-modified glycerol triacrylate, EO-modified glycerol triacrylate, PO-modified glycerol triacrylate, tris(ac oxyethyl) isocyanulate, dipentaerythritol hexaacrylate (DPHA), caprolactone-modified dipentaerythritol hexaacrylate, dipentaerythritol hydroxypentaacrylate, alkyl-modified dipentaerythritol pentaacrylate, alkyl-modified dipentaerythritol tetraacrylate, alkyl-modified dipentaerythritol triacrylate, dimethylol propanetetraacrylate (DTMPTA), pentaerythritol ethoxyteteraacrylate, EO-modified phosphoric acid triacrylate and 2,2,5,5-tetrahydroxymethylcyclopentanone tetraacrylate. These monomers may be used alone or in combination.

The formulated ratio of the tri- or more functional radical polymerizable monomer having no charge transporting structure is 20% by mass to 80% by mass, and preferably 30% by mass to 70% by mass with respect to the total amount of the crosslinked surface layer. In the case where the ratio thereof is less than 20% by mass, the concentration of the three dimensional crosslinkage becomes low in the crosslinked surface layer, and the significant improvement of abrasion resistance cannot be attained compared with the case using the conventional thermoplastic binder resin. In the case where the ratio thereof is more than 80% by mass, the content of the charge transporting compound is decreased, and thus the electric characteristics are degraded. Although it is uneasy to state as the required abrasion resistance and electric characteristics tend to change depending on the process to be used, the formulated ratio thereof is particularly preferably in the range of 30% by mass to 70% by mass in view of the balance between the abrasion resistance and electric characteristics.

The aforementioned radical polymerizable compound having a charge transporting structure denotes a compound which has a charge transporting structure such as a hole transporting structure (e.g. triaryl amine, hydrazone, pyrrazoline and/or carbazol) and an electron transporting structure (e.g. condensated polycyclic quinone, diphenoquinone, and an electron attractive aromatic ring having a cyano group and/or a nitro group), and also has a radical polymerizable functional group. Examples of the radical polymerizable functional group are those listed in the descriptions of the radical polymerizable monomer. Among them, an acryloyloxy group and a methacryloyloxy group are particularly preferred.

The radical polymerizable compound having a charge transporting structure may have two or more functional groups, but preferably has one functional group in view of the film quality and electrostatic characteristics. When two or more functional radical polymerizable compound having a charge transporting structure is used, the charge transporting structure is fixed in the crosslinked structure via a plurality of bonds. However, as the charge transporting structure is extremely bulky, distortion may caused in the cured resin and the internal stress of the crosslinked surface layer becomes high. Therefore, cracks or scratches tend to be formed due to the deposition of carrier, or the like. These problems may not occur when the thickness of the crosslinked surface layer is 5 μm or less. In the case where the thickness is more than 5 μm, the internal stress of the crosslinked surface layer becomes extremely high and cracks tend to be caused just after the formation of crosslinkages.

From the view point of the electrostatic characteristics, in case where the two or more functional charge transporting compound is used, an intermediate structure (cation radical) at the time of the charge transportation cannot be stably maintained as the charge transporting structure is fixed in the crosslinked structure via a plurality of bonds. The decline of the sensitivity and increase of residual potential tend to occur due to the trapped elect go. These degradation of the electric characteristics appears in an image as the lowered image density or thinned printed characters. Therefore, the radical polymerizable compound having a mono-functional charge transporting structure is used as the radical polymerizable compound having a charge transporting structure, and the charge transporting structure is fixed in between the crosslinked structure in the fashion of pendant. Therefore, the formation of cracks or scratches is suppressed and the electrostatic characteristics are stabilized.

A triarylamine structure is effective as the charge transporting structure. The number of the functional group thereof is preferably one. Specifically, the compound having the structure represented by the following general formula (1) or (2) is preferably since the electric characteristics such as sensitivity, residual potential and the like are suitably maintained.

General formula (1)

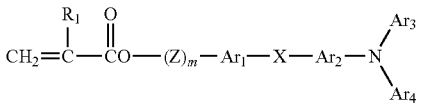

-continued

General formula (2)

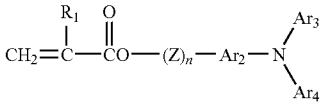

In the above general formulae, $R_1$ denotes a hydrogen atom, halogen atom, alkyl group which may have a substitute, aralkyl group which may have a substitute, aryl group which may have a substitute, cyano group, nitro group, alkoxy group, —$COOR_7$ (wherein $R_7$ denotes a hydrogen atom, alkyl group which may have a substitute, aralkyl group which may have a substitute, or aryl group which may have a substitute), halogenated carbonyl group, or $CONR_8R_9$ (wherein each of $R_8$ and $R_9$ denotes a hydrogen atom, halogen atom, alkyl group which may have a substitute, aralkyl group which may have a substitute, or aryl group which may have a substitute, and $R_8$ and $R_9$ are identical or different to each other); each of $Ar_1$ and $Ar_2$ denotes an arylene group which may have a substitute, and $Ar_1$ and $Ar_2$ are identical or different to each other; each of Ar3 and Ar4 denotes an aryl group which may have a substitute, and Ar3 and Ar4 are identical or different to each other; X denotes a single bond, alkylene group which may have a substitute, cycloalkylene group which may have a substitute, alkylether group which may have a substitute, oxygen atom, sulfur atom, or vinylene group; Z denotes an alkylene group which may have a substitute, alkylene ether group which may have a substitute, or alkyleneoxycarbonyl group; and each of m and n denotes an integer of 0 to 3.

Hereinafter, the specific examples of the general formulae (1) and (2) will be described.

In the general formulae (1) and (2), among the substitutes of R1, examples of the alkyl groups include a methyl group, ethyl group, propyl group, butyl group, and the like, examples of the aryl group include a phenyl group, naphthyl group, and the like, examples of the aralkyl group include a benzyl group, phenethyl group, naphthylmethyl group, and the like, and examples of the alkoxyl group include a methoxy group, ethoxy group, propoxy group, and the like. These may be further substituted with a halogen atom, nitro group, cyano group, alkyl group such as a methyl group or ethyl group, alkoxy group such as a methoxy group or ethoxy group, aryloxy group such as phenoxy group, aryl group such as a phenyl group or naphthyl group, aralkyl group such as a benzyl group or phenethyl group, or the like.

Among the aforementioned example of the substitute of $R_1$, the hydrogen atom and methyl group are particularly preferable.

Each of Ar3 and Ar4 which may be substituted is an aryl group, and examples of such an aryl group include a condensed polycyclic hydrocarbon group, non-condensed cyclic hydrocarbon group, heterocyclic group, and the like.

Examples of the condensed polycyclic hydrocarbon group include the ones wherein 18 or less numbers of carbon atoms are forming a ring. Specific examples thereof include a pentanyl group, indenyl group, naphthyl group, azulenyl group, heptalenyl group, biphenylenyl group, as-indacenyl group, s-indacenyl group, fluolenyl group, acenaphthylenyl group, preiadenyl group, acenaphthenyl group, phenalenyl group, phenantryl group, antryl group, fluorantenyl group, acephenanthrylenyl group, aceanthrylenyl group, triphenyleyl group, pyrenyl group, chrysenyl group, naphthacenyl group, and the like.

Examples of the non-condensed cyclic hydrocarbon group include monovalent group of monocyclic hydrocarbon group such as benzene, diphenyl ether, polyethylene diphenyl ether, diphenyl thioether, and diphenyl sulfone; monovalent group of non-condensed polycyclic hydrocarbon group such as biphenyl, polyphenyl, diphenyl alkans, diphenylalkenes, diphenyl alkyne, triphenyl methane, distytyl benzene, 1,1-diphenylcycloalkanes, polyphenyl alkans, polyphenyl alkenes; and a monovalent group of ring aggrenation hydrocarbon such as 9,9-diphenyl fluorenone.

Examples of the heterocyclic group include a monovalent group of carbozole, dibenzofuran, dibenzothiophene, oxadiazole, and thiadiazole.

The aryl groups for use as Ar3 and Ar4 may be substituted with the following groups.

(1) A halogen atom, cyano group, nitro group, or the like.

(2) An alkyl group, preferably C1-C12 linear or branched alkyl group, more preferably C1-C8 linear or branched alkyl group, even more preferably C1-C4 linear or branched alkyl group, which may have a fluorine atom, hydroxyl group, cayano group, C1-C4 alkoxy group, phenyl group, phenyl group substituted with a halogen atom, C1-C4 alkyl group, or C1-C4 alkoxy group. Specific examples of such groups include a methyl group, ethyl group, n-butyl group, i-propyl group, t-butyl group, s-butyl group, n-propyl group, trifluolomethyl group, 2-hydroxyethyl group, 2-ethoxyethyl group, 2-cyanoethyl group, 2-methoxyethyl group, benzyl group, 4-chlorobenzyl group, 4-methylbenzyl group, 4-phenylbenzyl group, and the like.

(3) An alkoxy group (—$OR_2$), where R2 represents the alkyl group defined in (2). Specific examples thereof includes a methoxy group, ethoxy group, n-propoxy group, i-propoxy group, t-butoxy group, n-butoxy group, s-butoxy group, i-butoxy group, 2-hydroxyethoxy group, benzyloxy group, trifluoromethoxy group, and the like.

(4) An aryloxy group, wherein the aryl group may be a phenyl group, naphthyl group, or the like, and the aryloxy group may have a substitute such as a C1-C4 alkoxy group, C1-C4 alkyl group, or halogen atom. Specific examples of such the aryloxy group include a phenoxy group, 1-naphthyloxy group, 2-naphthyloxy group, 4-methoxyphenoxy group, 4-methylphenoxy group, and the like.

(5) An alkylmercapto group or arylmercapto group. Specific example thereof including a methylthio group, ethylthio group, phenylthio group, p-methyphenylthio group, and the like.

(6)

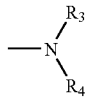

In the formula above, each of R3 and R4 denotes a hydrogen atom, alkyl group defined in (2), or aryl group. Examples of the aryl group include a phenyl group, biphenyl group, and naphthyl group, and these may have a substitute such as a C1-C4 alkoxy group, C1-C4 alkyl group, or halogen atom. R3 and R4 may form a ring in combination. Specific examples of the group expressed by the above formula include an amino group, diethyl amino group, N-methyl-N-phenyl amino group, N-diphenyl amino group, N,N-di(tolyl)amino group, dibenzylamino group, piperidino group, morpholino group, pyrrolidino group, and the like.

(7) An alkylenedioxy group such as a methylenedioxy group, or an alkylenedithio group such as a methylenedithio.

(8) A substituted or unsubstituted styryl group, substituted or unsubstituted β-phenylstyryl group, diphenylaminophenyl group, ditolylaminophenyl group, and the like.

As the arylene group for use in $Ar_1$ and $Ar_2$, divalent groups delivered from the aryl groups mentioned above for use in $Ar_3$ and $Ar_4$ can be used.

X denotes a group of a single bond, specifically a substituted or unsubstituted alkylene group, substituted or unsubstituted cycloalkylene group, substituted or unsubstituted alkylene ether group, oxygen atom, sulfur atom, vinylene group, or the like.

The substituted or unsubstituted alkylene group is C1-C12 linear or branched alkylene group, preferably C1-C8 linear or branched alkylene group, and more preferably C1-C4 linear or branched alkylene group, and these alkylene groups may have a fluorine atom, hydroxyl group, cyano group, C1-C4 alkoxy group, phenyl group, or phenyl group which is further substituted with a halogen atom, C1-C4 alkyl group, or C1-C4 alkoxy group. Specific examples of such the substituted or unsubstituted alkylene group include a methylene group, ethylene group, n-butylene group, propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, 4-biphenylethylene group, and the like.

The substituted or unsubstituted cycloalkylene group is a C5-C7 alkylene group, and such the cyclic alkylene group may further have a fluorine atom, hydroxyl group, C1-C4 alkyl group, C1-C4 alkoxy group, or the like. Specific examples thereof include a cyclohexylidene group, cyclohexylene group, 3,3-dimethylcyclohexylidene, group, and the like.

The substituted or unsubstituted alkylene ether group is any of an ethyleneoxy group, propyleneoxy group, ethyleneglycol group, propyleneglycol group, diethyleneglycol group, tetraethylene glycol group, or tripropyleneglycol group, and the alkylene group within the alkylene ether group may have a substituent such as a hydroxyl group, methyl group, ethyl group, or the like.

The vinylene group is expressed by the following formulae:

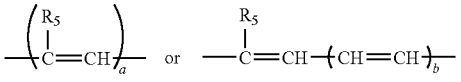

In the above formulae, $R_5$ denotes an alkyl group (the same as the alkyl group defined in (2)), or aryl group (the same as the aryl group denotes by $Ar_3$ and $Ar_4$), and a denotes an integer of 1 or 2 and b denotes any integer of 1 to 3.

Z denotes a substituted or unsubstituted alkylene group, substituted or unsubstituted alkylene ether group, or alkyleneoxycarbonyl group.

Examples of the substituted or unsubstituted alkylene group are those listed as the alkylene group of X.

Examples of the substituted or unsubstituted alkylene ether group are those listed as alkylene ether group of X.

Examples of the alkyleneoxycarbonyl group include a caprolactone-modified group.

Moreover, especially preferable examples of the radical polymerizable compound having a monovalent charge transporting structure are the compounds having a structure expressed by the following general formula (3):

General formula (3)

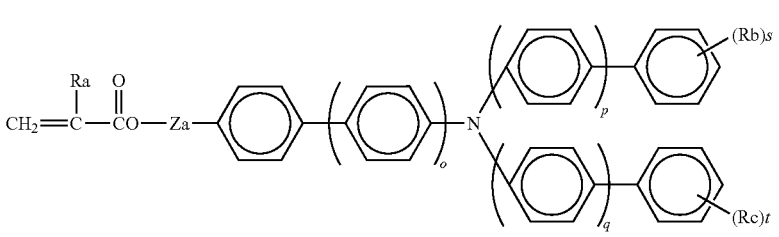

In the general formula (3), each of o, p and q denotes an integer of 0 or 1; Ra denotes a hydrogen atom or methyl group; each of Rb and Rc denotes a C1-C6 alkyl group (does not include a hydrogen atom) and in case where there are a plurality of Rb or Rc, they may be different to each other; s denotes any integer of 0 to 3; and Za denotes a group of a single bond, such as a methylene group, ethylene group, and the groups expressed by the following formulae;

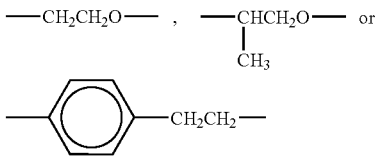

The compound expressed by the general formula (3) is preferably a compound having a methyl group and ethyl group as substituents of Rb and Rc.

The mono-functional radical polymerizable compound having the charge transporting structures represented by the general formulae (1), (2), or especially (3) for use in the present invention is polymerized by releasing the C—C double bond in the both sides, therefore the charge transporting structure is incorporated into a polymer chain, not located at the terminals of the resultant polymer. Specifically, the charge transporting structure is incorporated in a main chain of the crosslinked polymer chain which is formed by the aforementioned mono-functional radical polymerizable compound and the tri- or more functional radical polymerizable monomer. Moreover, the charge transporting structure is incorporated in a crosslinking chain present between two main polymer chains, and such the crosslinking chain is classified into intermolecular a crosslinking chain which is present between one polymer molecular and another polymer molecular, and an intramolecular crosslinking chain which crosslinks between a segment of a main chain folded within one polymer molecular and another monomer-derived segment polymerized at a part of the main chain where is distant from the aforementioned segment. In any of these cases, a tricrylamine group which is a pendant of the main chain has at least three aryl groups spirally positioned from a nitrogen atom, and is bulky. However, it is connected with the main chain via a carbonyl group, without directly connecting to the main chain, and therefore is fixed while being fairly free in a three-dimensional space. Therefore, these triaryl amine structures are appropriately adjacent to each other in the space within the polymer, and thus the crosslinked polymer has little physical strain. In addition, in the case where the crosslinked surface layer is formed as an outermost layer, an occurrence of a problem in that the charge transporting passage is disconnected can be prevented.

The radical polymerizable compound having a charge transporting structure for use in the present invention plays an important roll as it imparts the charge transporting function in the crosslinked surface layer. The amount thereof is 20% by mass to 80% by mass, and preferably 30% by mass to 70% by mass with respect to the total amount of the crosslinked surface layer. In the case where the amount thereof is less than 20% by mass, the charge transporting function of the crosslinked surface layer cannot be sufficiently maintained. In the case where the amount thereof is more than 80% by mass, the content of the tri- or more functional monomer having no charge transporting structure is decreased, and thus high abrasion resistance cannot be achieved due to the decreased density of the crosslink bond. Although it cannot be stated as the required electric characteristics and abrasion resistance are changed depending on the process for use, it is preferably in the range of 30% by mass to 70% by mass in view of the balance between the both characteristics.

The cross linked surface layer is formed by curing the mixture containing at least the tri- or more functional radical polymerizable monomer having no charge transporting structure and the radical polymerizable compound having a charge transporting structure. In order to control the viscosity at the time of coating, to reduce the stress in the crosslinked surface layer, to reduce the surface energy or friction coefficient, a mono- or bi-functional radical polymerizable monomer, and/or an oligomer can be added thereto. As the aforementioned radical polymerizable monomer and/or oligomer, those known in the art can be used.

Examples of monofunctional radical polymerizable monomer include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethyleneglycol acrylate, phenoxytetraethyleneglycol acrylate, cetylacrylate, isostearyl acrylate, stearyl acrylate, styrene monomer, and the like.

Examples of bifunctional radical polymerizable monomer include 1,3-butandiol diacrylate, 1,4,butandiol diacrylate, 1,4-butandiol dimethacrylate, 1,6-hexanediol diacrylate, 1,6-hexandiol dimetacrylate, diethyleneglycol diacrylate, neopentylglycol diacrylate, EO-modified bisphenol A diacrylate, EO-modified bisphenol F diacrylate, and the like.

Examples of the functional monomer include fluorine-containing monomers such as octafluoropentyl acrylate, 2-perfluorooctylethyl acrylate, 2-perfluorooctylethyl methacrylate, and 2-perfluoroisonylethyl acrylate, in which fluorine atoms are substituted; and vinyl monomers, acrylates and monoacrylates each having a polysiloxane group such as siloxane units having a repeating number of 20 to 70, disclosed in Japanese Patent Application Publication (JP-B) Nos. 05-60503 and 06-45770, e.g. acryloyl polydimethylsiloxianethyl, methacryloyl polydimethylsiloxane ethyl, acryloyl polydimethylsiloxane propyl, acryloyl polydimethylsiloxane butyl, diacryloyl polydimethylsiloxane diethyl and the like.

Examples of the radical polymerizable oligomer include oligomers of epoxy acrylate, urethane acrylate, polyester acrylate, and the like. Note that, the large content of the mono- or bi-functional radical polymerizable monomer and/or the radical polymerizable oligomer may practically reduce the density of three-dimensional crosslinks in the crosslinked surface layer, and this may cause the declined abrasion resistance thereof. Therefore, the amount of these monomer and oligomer is 50 parts by mass or less, and preferably 30 parts by mass or less, with respect to 100 parts by mass of the tri- or more functional radical polymerizable monomer.

Moreover, the crosslinked surface layer is a layer formed by applying an optical energy, and curing the mixture containing at least the tri or more functional radical polymerizable monomer having no charge transporting structure and the radical polymerizable compound having a charge transporting structure. However, a polymerization initiator may be optionally contained in the crosslinked surface layer in order to efficiently proceed with the crosslink reaction.

Specific examples of the polymerization initiator include: acetophenone or ketal photopolymerization initiators such as diethoxyacetophenone, 2,2-dimethoxy-1,2-diphenylethane-1-one, 1-hydroxy-cyclohexyl-phenyl-ketone, 4-(2-hydroxyehoxy)phenyl-(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl)oxime; benzoin ether photopolymerization initiators such as benzoin, benzoin methyl ether, benzoin ethyl ether, benzoin isobutyl ether, and benzoin isopropyl ether; benzophenone photopolymerization initiators such as benzophenone, 4-hydroxybenzophenone, o-benzoylbenzoic acid methyl ether, 2-benzoyl naphthalene, 4-benzoyl bisphenyl, 4-benzoyl phenyl ether, acrylated benzophenone, and 1,4-benzyl benzene; thioxanthone photopolymerization initiators such as 2-isopropylthioxanthone, 2-chlorothioxane, 2,4-dimethylthioxanthone, 2,4-diethylthioxanthone, and 2,4-dichlorothioxanthone; and other photopolymerization initiators such as ethylanthraquinone, 2,4,6-trimethylbenzoyldiphenylphosphineoxide, 2,4,6-trimethylbenzoylphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds, imidazole compounds, and the like. In addition, photopolymerization accelerator can be used alone or in combination with the aforementioned photopolymerization initiator. Specific examples thereof include triethanol amine, methyldiethanol amine, ethyl 4-dimethylaminobenzoate, isoamyl 4-dimethylaminobenzoate, 2-dimethylaminoethylbenzoate, 4,4'-dimethylaminobenzophenone, and the like.

The aforementioned polymerization initiator can be used singly, or in combination of two or more. The amount of the polymerization initiator is 0.5 parts by mass to 40 parts by mass, and preferably 1 part by mass to 20 parts by mass, with respect to 100 parts by mass of the total of the radical polymerizable contents.

Furthermore, a coating solution of the crosslinked surface layer optionally contains additives such as various plasticizers (for reducing the stress and improving the adherence), leveling agent, low molecular charge transporting material having no radical polymerizability, and the like. Specific examples of the plasticizer include known plasticizers for use in general resins, such as dibutyl phthalate, and dioctyl phthalate. The added amount of the plasticizer is 20% by mass or less, and preferably 10% by mass with respect to the total solid contents of the coating solution of the crosslinked surface layer. Specific examples of the leveling agent include: silicone oil such as dimethyl silicone oil, methylphenyl silicone oil, and the like; polymers and oligomers having a perfluoroalkyl group in side chains thereof. The added amount of the leveling agent is appropriately 3% by mass or less with respect to the total solids content of the coating solution of the crosslinked surface layer.

The crosslinked surface layer is formed by coating the coating solution containing at least the tri- or more functional radical polymerizable monomer having no charge transporting structure and the radical polymerizable compound having a charge transporting structure, and curing the coated layer. In the case where the radical polymerizable monomer is a liquid, other components can be dissolved therein to form the coating solution of the crosslinked surface layer, but it may be further diluted with a solvent, if necessary. Specific examples of the solvent include: alcohols such as methanol, ethanol, propanol, butanol, and the like; ketones such as acetone, methylethylketone, methylisobutylketone, cyclohexanone, and the like; esters such as ethyl acetate, butyl acetate, and the like; ethers such as tetrahydrofuran, dioxane, propyl ether, and the like; halogenated solvents such as dichloromethane, dichloroethane, trichloroethane, and chlorobenzene; aromatic solvents such as benzene, toluene, xylene, and the like; cellosolves such as methyl cellosolve, ethyl cellosolve, cellosolve acetate, and the like. These solvents can be used singly or in combination of two or more. The dilution ratio by the solvent is arbitrary adjusted depending on the solubility of the components, coating method, intended film thickness, and the like. The coating can be performed by a dip coating method, spray coating method, bead coating method, ring coating method, or the like.

After coating the aforementioned coating solution of the crosslinked surface layer, a light energy is externally applied to the coated layer so as to cure the layer. Examples of the light energy include: ultraviolet light sources, such as a high-pressure mercury lamp and metal halide lamp, each having an emission wavelength in the ultraviolet region; and visible light sources which emit the light of a wavelength region covering the absorption wavelengths of the aforementioned radical polymerizable contents and photopolymerization initiator. The light intensity of the radiation is preferably in the range of from 300 mW/cm$^2$ to 1,000 mW/cm$^2$. When the light intensity is less than 300 mW/cm2, the curing reaction requires a long period of complete. When the light intensity is more than 1,000 mW/cm$^2$, the progress of the reaction becomes uneven within the layer, and thus the texture of the crosslinked surface layer becomes significantly rough.

In the case where the curing is performed by the light energy, it is preferably that the oxygen density is reduced so as to prevent obstruction of crosslink by oxygen.

As the composition for the coating solution of the crosslinked surface layer, the binder resin can be contained therein, provided that it does not adversely affect the smoothness, electric characteristics, or resistance of the surface of the photoconductor. However, polymer materials such as the binder resin does not have a good compatibility with polymer generated as a result of the curing reaction of the radical polymerizable composition (radical polymerizable monomer and radical polymerizable compound having a charge transporting structure), and then a phase separation may occur in the coating solution of the crosslinked surface layer. As a result, the resulted layer has a significantly irregular surface. Therefore, it is preferable that the binder resin is not contained in the coating solution of the crosslinked surface layer.

In order to maintain the electric characteristics thereof, the crosslinked surface layer contains bulky charge transporting structures therein, and it is necessary to increase the density of crosslinks so as to increase the physical strength. If the curing reaction of such the crosslinked surface layer is rapidly progressed, after being coated, by externally applying extremely high energy, the curing is proceeded unevenly and thus the resulted layer ends up having an irregular surface. Therefore, it is preferably to use an external light energy which is capable of controlling the reaction speed depending on the light intensity and the usage amount of the polymerization initiator.

The coating method of the crosslinked surface layer is explained as follow. In the case where an acrylate monomer having three acryloyloxy groups and a tryarylamine compound having one acryloyloxy group are used for the coating solution, the usage ratio thereof is 7/3 to 3/7. The polymerization initiator is added thereto at 3% by mass to 20% by mass with respect to the total amount of the acrylate compound, and a solvent is added thereto so as to prepare the coating solution. In the case where tryarylamine donor is used as the charge transporting material and polycarbonate is used as the binder resin in the charge transporting layer which is the underlying layer of the crosslinked surface layer, and the crosslinked surface layer is formed by spray coating, the aforementioned solvent of the coating solution is preferably tetrahydrofuran, 2-butanone, ethyl acetate, or the like, and the usage ratio of such the solvent is preferably 3 times to 10 times of the total amount of the acrylate compound.

Sequentially, the coating solution prepared in the manner mentioned above is coating by spraying on, for example, a photoconductor wherein an undercoat layer, a charge generating layer, and the aforementioned charge transporting layer are laminated on a substrate, e.g. an aluminum cylinder, in this order. Thereafter, it is dried at a relatively low temperature for a short period (25° C. to 80° C., 1 minute to 10 minutes), and then is cured by heating or UV irradiation.

A metal halide lamp or the like is used for the UV irradiation, and the illuminance (365 nm) thereof is preferably in the range of 300 mW/cm$^2$ to 1,000 mW/cm$^2$. In the case where the UV light is irradiated at 600 mW/cm$_2$, the entire surface of the coated layer s uniformly exposed to the UV light for 45 to 360 seconds while rotating the drum of the photoconductor. At this time, the temperature of the drum is adjusted so as not to exceed 100° C.

After the completion of the curing, it is heated at 100° C. to 150° C. for 10 minutes to 30 minutes so as to reduce the residual solvent, to thereby yield the photoconductor.

EXAMPLES

Hereinafter, examples and comparative examples of the present invention will be explained, but it shall not be construed to limit the scope of the present invention.

The apparatus used in the examples is shown in FIG. 10.

Evaluation Method:

A UV lamp was disposed nearby a cylindrical substrate to which a charge transporting layer had been coated and dried, the surface temperature of the cylindrical substrate was measured by means of a thermocouple and data logger, and the variations of the temperature were evaluated at three points, i.e. an upper portion, center portion, and bottom portion of the cylindrical substrate.

Note that, an Al substrate (outer diameter of 100 mm) was dip-coated in a coating solution of the charge transporting layer having the following formula, the coated layer was heated and dried to thereby form a charge transporting layer having a thickness of 20 μm.

<Coating Solution of a Charge Transporting Layer>

| | |
|---|---|
| Bisphenol Z polycarbonate (Panlite TS-2050, manufactured by Teijin Chemicals Ltd.) | 10 parts by mass |
| Low molecular charge transfering material | 10 parts by mass |

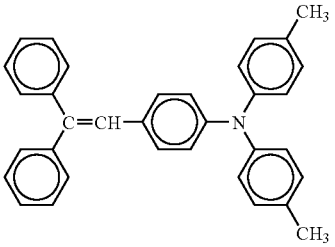

| | |
|---|---|
| Tetrahydrofulane | 80 parts by mass |
| 1% tetrahydrofulane solution of silicone oil | 0.2 parts by mas |

The conditions in Examples 1-5 and Comparative Example 1 were as follows:

UV lamp: UV lamp manufacture by Fusion UV Systems Japan K.K. (bulb type: H-bulb)

Distance between the UV lamp and the surface of the cylindrical substrate: 53 mm Duration of irradiation by UV lamp: 2 minutes Rotation frequency of the cylindrical substrate at the time of UV irradiation: 50 rpm Example 1

External diameter of the cylindrical conductive substrate: 100 mm

Total length of the cylindrical conductive substrate: 380 mm

Refrigerant: water

Length of the refrigerant supplying pipe: 400 mm

Space between the refrigerant supplying pipe and the holding part of the cylindrical elastic body: 2 mm Pressure for supplying the refrigerant: 2,000 hPa/cm$^2$ Thickness of a cylindrical elastic body: 1.5 mm Temperature of the refrigerant: 30° C.

Constant-temperature water bath: setting at 30° C. (coolability 1,500 W)

Circulation flow rate of the refrigerant: 5 L/min.

Example 2

External diameter of the cylindrical conductive substrate: 100 mm

Total length of the cylindrical conductive substrate: 380 mm

Refrigerant: water

Length of the refrigerant supplying pipe: 350 mm

Space between the refrigerant supplying pipe and the holding part of the cylindrical elastic body: 2 mm Pressure for supplying the refrigerant: 5,000 hPa/cm$^2$ Thickness of a cylindrical elastic body: 1.0 mm Temperature of the refrigerant: 30° C.

Constant-temperature water bath: setting at 30° C. (coolability 1,500 W)

Circulation flow rate of the refrigerant: 3 L/min.

Example 3

The conditions were set the same as in Example 1, provided that the following conditions were changed as described.

Length of the refrigerant supplying pipe: 100 mm

Pressure for supplying the refrigerant: 500 hPa/cm$^2$

Thickness of a cylindrical elastic body: 4.0 mm

Examples 4

The conditions were set the same as in Example 1, provided that the following conditions were changed as described.

Space between the refrigerant supplying pipe and the holding part of the cylindrical elastic body: 1.5 mm Thickness of a cylindrical elastic body: 3.5 mm Circulation flow rate of the refrigerant: 1.8 L/min.

Example 5

The conditions were set the same as in Example 2, provided that the following condition was changed as described.

Constant-temperature water bath: none

Comparative Example 1

The conditions were set the same as in Example 2, provided that the following conditions were changed as described.

Refrigerant: none

Constant-temperature water bath: none

The results of the temperature control are shown in Table 1.

Note that, the criteria for the evaluation are as follow:

A: Difference in the temperature is 0° C. or more but less than 5° C.

B: Difference in the temperature is 5° C. or more but less than 10° C.

C: Difference in the temperature is 10° C. or more but less than 30° C.

D: Difference in the temperature is 30° C. or more

TABLE 1

| | Top (° C.) | Center (° C.) | Bottom (° C.) | Temperature difference (° C.) | Evaluation |
|---|---|---|---|---|---|
| Ex. 1 | 42.5 | 41.0 | 40.0 | 2.5 | A |
| Ex. 2 | 44.5 | 43.0 | 42.5 | 2.0 | A |
| Ex. 3 | 49.5 | 39.0 | 40.0 | 10.5 | B |
| Ex. 4 | 43.5 | 46.5 | 50.5 | 7.0 | C |
| Ex. 5 | 49.5 | 44.0 | 41.5 | 8.0 | C |
| Com. 1 | 145 | 120 | 115 | 30 | D |

Example 6

An undercoat layer was formed by a dip coating method on the Al substrate (external diameter: 100 mm) so as to have a layer thickness of 3.5 μm after drying.

<Coating Solution of the Undercoat Layer>

| | |
|---|---|
| Alkyd resin (BECKOSOL 1307-60-EL, DIC Corporation) | 6 parts by mass |
| Melamine resin (SUPER BECKAMINE G-821-60, DIC Corporation) | 4 parts by mass |
| Titanium oxide (CR-EL, Ishihara Sangyo Kaisha, Ltd.) | 40 parts by mass |
| Methylethylketone | 50 parts by mass |

Onto the undercoat layer, the following coating solution of a charge generating layer was dip-coated, and the coated layer was heated and dried to thereby form a charge generating layer having a thickness of 0.3 μm.

<Coating Solution of the Charge Generating Layer>

| | |
|---|---|
| Y-form titanyl phthanyl phthalocyanine | 4 parts by mass |
| Polyvinyl butyral (S-LEC BM-S, Sekisui Chemical Co., Ltd.) | 2 parts by mass |
| Methylethylketone | 150 parts by mass |

Onto the charge generating layer, the following coating solution of a charge transporting layer was dip-coated, and the coated layer was heated and dried to thereby form a charge generating layer having a thickness of 22 μm.

<Coating Solution of the Charge Transporting Layer>

| | |
|---|---|
| Bisphenol Z polycarbonate (Panlite ® TS 2050, Teijin Chemicals Ltd.) | 10 parts by mass |
| Low molecular charge transporting material represented by the following formula | 10 parts by mass |

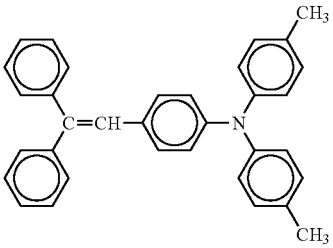

| | |
|---|---|
| Tetrahydrofuran | 80 parts by mass |
| 1% tetrahydrofuran solution of silicone oil (KF50, Shin-Etsu Chemical Co., Ltd.) | 0.2 parts by mass |

On the charge transporting layer, the following coating solution of a crosslinked surface layer was spray coated, and the irradiation of UV light and the temperature control were performed at the same conditions as in Example 1. After the UV radiation, it was dried at 130° C. for 30 minutes so as to obtain the crosslinked surface layer having a thickness of 9.0 μm, to thereby yield an electrophotographic photoconductor.

<Coating Solution of the Crosslinked Surface Layer>

| | |
|---|---|
| Tri-or more functional radical polymerizable monomer having no charge transporting structure (KAYARAD TMPTA, Nippon Kayaku Co., Ltd.) | 8 parts by mass |

-continued

| | |
|---|---|
| Tri-or more functional radical polymerizable monomer having no charge transporting structure (KAYARAD DPCA120, Nippon Kayaku Co., Ltd.) | 2 parts by mass |
| Radical polymerizable compound having the charge transporting structure represented by the following formula | 10 parts by mass |

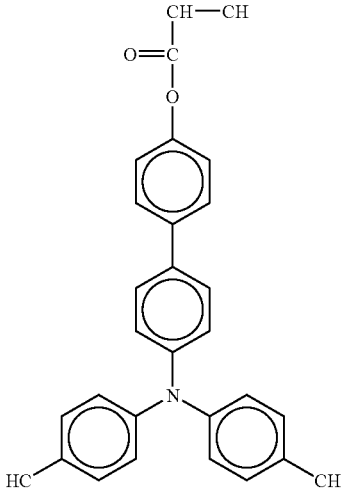

| | |
|---|---|
| Photopolymerization initiator, i.e. 1-hydroxy-cylohexyl-phenyl-ketone (IRGACURE 184, Ciba Japan K.K.) | 1 part by mass |
| Tetrahydrofuran | 80 parts by mass |

Comparative Example 2

The electrophotographic photoconductor of Comparative Example 2 was prepared in the same manner as in Example 6, provided that the irradiation of UV light and the temperature control were performed at the same conditions as in Comparative Example 1.

The thus obtained electrophotographic photoconductor was disposed in Imagio MF1350 (Ricoh Company Limited), and 4,000,000 pieces of paper (A4 size. My Paper, NBS Ricoh Co., Ltd.) were subjected to the printing test (Initial charge potential: −800V). Thereafter, the wear characteristics, charge potential in the device, and the printed image were evaluated. The results of the wear characteristics (the depth of wear) are shown in Table 2, the results of the charge potential in the device are shown in Table 3, and the evaluations of the image are shown in Table 4.

TABLE 2

| | Number of the printed paper | |
|---|---|---|
| | 2,000,000 | 4,000,000 |
| Ex. 6 | 4.2 | 8.0 |
| Com. 2 | 3.5 | 6.0 |

Note that, in Table 2, the unit for the depth of wear is μm.

TABLE 3

| | Number of the printed paper | | | | | |
|---|---|---|---|---|---|---|
| | Initial | | 2,000,000 | | 4,000,000 | |
| | Dark part | Exposed part | Dark part | Exposed part | Dark part | Exposed part |
| Ex. 6 | 800 | 130 | 760 | 150 | 700 | 180 |
| Com. 2 | 800 | 210 | 780 | 300 | 720 | 450 |

Note that, in Table 3, the unit to the charge potential is −V.

TABLE 4

| | Number of the printed paper | | |
|---|---|---|---|
| | Initial | 2,000,000 | 4,000,000 |
| Ex. 6 | A | A | A |
| Com. 2 | B | C | C |

Note that, in Table 4, A represents an excellent image, B represents an image having a slightly lowered image density, and C represents an image having a significantly lowered image density.

As has clearly explained above, the temperature control unit of the present invention enables to uniformly control the temperature of the cylindrical substrate, and as a result, an electrophotographic photoconductor having excellent wear characteristics, electric characteristics and image quality can be produced.

The invention claimed is:

1. A temperature control unit for an electrophotographic photoconductor substrate, said electrophotographic photoconductor substrate comprising a coated layer, and an entire face of said electrophotographic photoconductor substrate being exposed to energy externally applied from a heating element while being rotated by a rotation system, characterized in that:

the temperature control unit comprising a stretchable membrane member, said membrane member detachably disposed in a hollow space of the cylindrical electrophotographic photoconductor substrate, wherein the membrane member is configured to sequentially stretch until reaching the deepest part of the hollow space of the cylindrical substrate as a result of an introduction of a refrigerant therein so as to closely contact with an entire inner wall of the cylindrical substrate, and to sequentially shrink to the original shape thereof as a result of a release of the refrigerant therefrom, so that the membrane member is detachably disposed in the hollow space of the cylindrical substrate, and wherein the membrane member is configured to make a heat transfer between a surface of the cylindrical substrate and the refrigerant introduced in the hollow space of the cylindrical substrate via the membrane member closely contacted with the inner surface of the cylindrical substrate, so as to control a surface temperature of the cylindrical substrate.

2. The temperature control unit of according to claim 1, further comprising an assisting system for a close contact of the membrane member, configured to assist the membrane member to closely contact with the entire inner wall of the cylindrical substrate at the time when the refrigerant is introduced.

3. The temperature control unit according to claim 1, further comprising:

a refrigerant introducing part, from which the pressurized refrigerant is introduced into the hollow space of the cylindrical substrate; and a refrigerant releasing part, to which the refrigerant introduced in the inside of the hollow part of the cylindrical substrate is spontaneously released.

4. The temperature control unit according to claim 3, wherein the refrigerant introducing part and the refrigerant releasing part are a double pipe comprising an inner pipe and an outer pipe, wherein the double pipe is disposed so as to be on the same axis to a rotation axis of the cylindrical substrate, and is configured to introduce and release the refrigerant in and from the hollow space of the cylindrical substrate, wherein the outer pipe is connected to an entrance part of the hollow space of the cylindrical substrate, and the inner pipe is inserted into the hollow space of the cylindrical space in a manner such that an opening thereof is located at the deepest part of the hollow space of the cylindrical substrate, so that the refrigerant flown out from the entrance part or the deepest part pushes and presses the membrane member towards the inner wall of the cylindrical substrate to make the membrane member contact with the inner wall of the cylindrical substrate.

5. The temperature control unit according to claim 4, wherein the double pipe has a width of an annular channel of 2 mm or more, where the annular channel is a space between an outer face of the inner pipe and an inner face of the outer pipe.

6. The temperature control unit according to claim 3, further comprising a refrigerant circulation system configured to reintroduce the spontaneously released refrigerant into the refrigerant introducing part via a temperature-constant bath.

7. The temperature control unit according to claim 1, wherein the membrane member is at least outer face of a bag structure, wherein the outer face of the bag structure has an elasticity, and functions as a chuck in a manner such that the outer face of the bag structure stretches as the refrigerant is introduced into the bag structure, and contacts with the inner wall of the cylindrical substrate so as to hold the cylindrical substrate.

8. The temperature control unit according to claim 7, wherein the bag structure is configured to release the refrigerant and shrink back to the original shape, once the introduction of the refrigerant is terminated.

9. The temperature control unit according to claim 7, wherein the temperature control unit further comprises a rigid tube disposed in the hollow space of the cylindrical substrate so as to be on the same axis to a rotation axis of the cylindrical substrate, and the bag structure is a cylindrical bag structure comprising a circular through-hole in a center thereof, wherein the cylindrical bag structure is disposed on the rigid tube so that an inner circumference of an inner surface of the membrane member contacts with an outer circumference of a surface of the rigid tube, and the refrigerant is introduced in between the outer circumference of the surface of the rigid tube and the inner circumference of the inner surface of the membrane member.

10. The temperature control unit according to claim 9, further comprising a pipe for the refrigerant, which is inserted into the circular through-hole of the cylindrical bag structure and is configured to introduce and release the refrigerant.

11. The temperature control unit according to claim 9, further comprising a couple of metal or resin disk pressing tools respectively disposed at the top and bottom of the cylindrical substrate, wherein the couple of metal or resin disk pressing tools are configured to perform a positioning of a location where the cylindrical substrate is held with the cylindrical elastic body.

12. The temperature control unit according to claim 9, further comprising:

a refrigerant storage tank;

a refrigerant supplying pipe connecting between the refrigerant storage tank and the cylindrical elastic body;

a pump equipped with the refrigerant supplying pipe, and configured to send the refrigerant from the refrigerant storage tank into the cylindrical elastic body;

a refrigerant releasing pipe connecting between the cylindrical elastic body and the refrigerant storage tank, and configured to release the circulated the refrigerant in the cylindrical elastic body to the refrigerant storage tank;

a pressure detector configured to monitor a pressure of the refrigerant; and a flow rate control system configured to control the flow rate of the refrigerant.

13. The temperature control unit according to claim 7, wherein the bag structure is a cylindrical elastic body which is detachably disposed in the hollow space of the cylindrical substrate.

14. The temperature control unit according to claim 13, wherein a thickness of the cylindrical elastic body at where closely contacting with the entire inner wall of the cylindrical substrate is 1.0 time to 2.0 times of a thickness of the top and bottom ends of the cylindrical elastic body at where contacting with the inner wall of the cylindrical substrate, and wherein a part of the cylindrical elastic body where the thickness thereof changes is shaped in a taper or a curve.

15. The temperature control unit according to claim 7, wherein the bag structure is a chuck configured to hold the cylindrical substrate from the hollow space of the cylindrical substrate, and to rotate thereof so as to rotate the cylindrical substrate while holding thereof.

* * * * *